US006653942B2

(12) United States Patent
Kadwell et al.

(10) Patent No.: US 6,653,942 B2
(45) **Date of Patent: *Nov. 25, 2003**

(54) SMOKE DETECTOR

(75) Inventors: Brian J. Kadwell, Holland, MI (US); Greg R. Pattok, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/005,436

(22) Filed: Dec. 3, 2001

(65) Prior Publication Data

US 2002/0060632 A1 May 23, 2002

Related U.S. Application Data

(63) Continuation of application No. 09/804,543, filed on Mar. 12, 2001, now Pat. No. 6,326,897, which is a continuation of application No. 09/456,470, filed on Dec. 8, 1999, now Pat. No. 6,225,910.

(51) Int. Cl.[7] ..... G08B 17/00

(52) U.S. Cl. ..... 340/630; 250/573; 250/574; 356/438

(58) Field of Search ..... 340/630, 628; 356/438, 436; 250/573, 574

(56) References Cited

U.S. PATENT DOCUMENTS

| | | | | |
|---|---|---|---|---|
| 3,968,379 | A | | 7/1976 | Crane |
| 3,980,997 | A | | 9/1976 | Berns et al. |
| 3,982,130 | A | | 9/1976 | Trumble |
| 4,001,800 | A | | 1/1977 | Franks |
| 4,063,227 | A | | 12/1977 | Peterson |
| 4,104,619 | A | | 8/1978 | Hesler |
| 4,131,888 | A | | 12/1978 | Galvin |
| 4,185,278 | A | | 1/1980 | Lintlemann et al. |
| 4,241,282 | A | | 12/1980 | Tresch et al. |
| 4,249,169 | A | | 2/1981 | Malinowski |
| 4,300,133 | A | | 11/1981 | Solomon |
| 4,319,234 | A | | 3/1982 | Rice |
| 4,420,746 | A | | 12/1983 | Malinowski |
| 4,469,953 | A | | 9/1984 | Fujisawa et al. |
| 4,539,556 | A | | 9/1985 | Dederich et al. |
| 4,614,968 | A | | 9/1986 | Rattman et al. |
| 4,647,785 | A | | 3/1987 | Morita |
| 4,678,921 | A | | 7/1987 | Nakamura et al. |
| 4,680,576 | A | | 7/1987 | Bauer |
| 4,758,733 | A | | 7/1988 | Mochizuki |
| 4,769,550 | A | | 9/1988 | Dolnick |
| 4,851,819 | A | | 7/1989 | Kawai et al. |
| 4,857,895 | A | * | 8/1989 | Kaprelian ..... 340/630 |
| 4,870,394 | A | | 9/1989 | Corl et al. |

(List continued on next page.)

*Primary Examiner*—Julie Lieu
(74) *Attorney, Agent, or Firm*—Price, Heneveld, Cooper, DeWitt & Litton

(57) ABSTRACT

A smoke detector includes a housing defining a dark chamber admitting test atmosphere. A light receiver is disposed within the chamber. A scatter emitter is positioned within the chamber such that light strikes the receiver when reflected off particles suspended in the test atmosphere. An obscuration emitter is positioned within the chamber such that light emitted is directed to the receiver unless obstructed by particles suspended in the test atmosphere. A smoke detect signal is generated responsive to a measurement made responsive to the scatter emitter and/or the obscuration emitter.

34 Claims, 13 Drawing Sheets

U.S. PATENT DOCUMENTS

| | | | |
|---|---|---|---|
| 4,901,056 | A | 2/1990 | Bellavia et al. |
| 5,053,754 | A | 10/1991 | Wong |
| 5,103,096 | A | 4/1992 | Wong |
| 5,117,219 | A | 5/1992 | Tice et al. |
| 5,138,562 | A | 8/1992 | Shaw et al. |
| 5,247,283 | A | 9/1993 | Kobayashi et al. |
| 5,341,214 | A | 8/1994 | Wong |
| 5,369,397 | A | 11/1994 | Wong |
| 5,400,014 | A | 3/1995 | Behlke et al. |
| 5,451,931 | A | 9/1995 | Muller et al. |
| 5,473,314 | A | 12/1995 | Mochizuki et al. |
| 5,523,743 | A | 6/1996 | Rattman et al. |
| 5,546,074 | A | 8/1996 | Bernal et al. |
| 5,552,765 | A | 9/1996 | Vane et al. |
| 5,576,697 | A | 11/1996 | Nagashima et al. |
| 5,592,147 | A | 1/1997 | Wong |
| 5,629,671 | A | 5/1997 | Morita |
| 5,673,020 | A | 9/1997 | Okayama |
| 5,691,704 | A | 11/1997 | Wong |
| 5,699,043 | A | 12/1997 | Vane et al. |
| 5,705,988 | A | 1/1998 | McMaster |
| 5,708,414 | A | 1/1998 | Peltier et al. |
| 5,719,557 | A | 2/1998 | Rattman et al. |
| 5,721,529 | A | 2/1998 | Vane et al. |
| 5,726,633 | A | 3/1998 | Wiemeyer |
| 5,751,218 | A | 5/1998 | Winterble et al. |
| 5,767,776 | A | 6/1998 | Wong |
| 5,896,088 | A | 4/1999 | Brooks, Jr. |
| 5,898,377 | A | 4/1999 | Adachi |
| 6,049,446 | A | 4/2000 | Ha et al. |
| 6,362,743 | B1 | 3/2002 | Tanguay et al. |

* cited by examiner

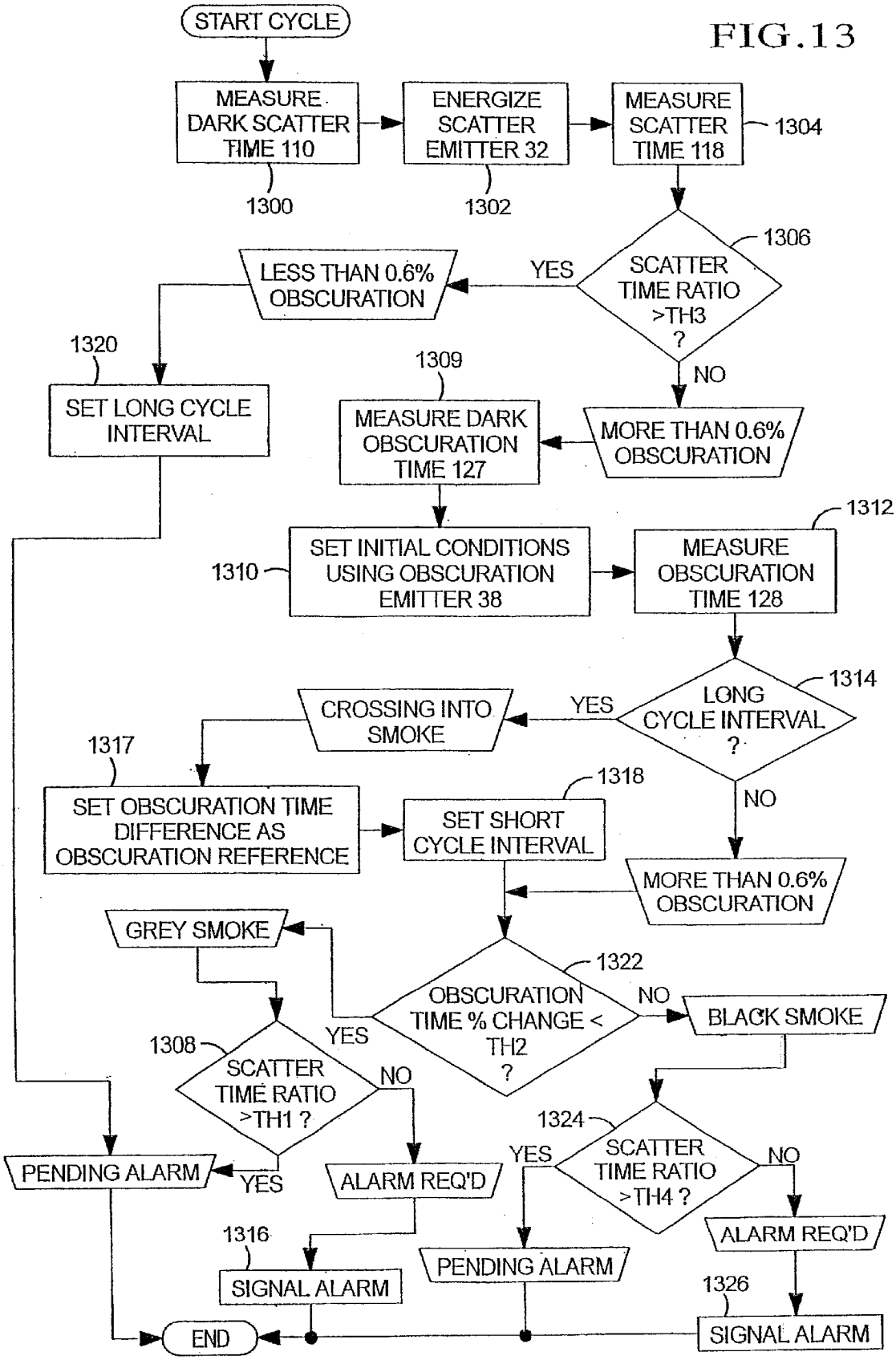
FIG.13
START CYCLE
MEASURE DARK SCATTER TIME 110
1300
ENERGIZE SCATTER EMITTER 32
1302
MEASURE SCATTER TIME 118
1304
SCATTER TIME RATIO >TH3 ?
1306
YES
LESS THAN 0.6% OBSCURATION
NO
MORE THAN 0.6% OBSCURATION
1320
SET LONG CYCLE INTERVAL
1309
MEASURE DARK OBSCURATION TIME 127
1310
SET INITIAL CONDITIONS USING OBSCURATION EMITTER 38
1312
MEASURE OBSCURATION TIME 128
LONG CYCLE INTERVAL ?
1314
YES
CROSSING INTO SMOKE
NO
MORE THAN 0.6% OBSCURATION
1317
SET OBSCURATION TIME DIFFERENCE AS OBSCURATION REFERENCE
1318
SET SHORT CYCLE INTERVAL
GREY SMOKE
OBSCURATION TIME % CHANGE < TH2 ?
1322
YES
NO
BLACK SMOKE
1308
SCATTER TIME RATIO >TH1 ?
NO
YES
PENDING ALARM
ALARM REQ'D
1324
SCATTER TIME RATIO >TH4 ?
YES
NO
ALARM REQ'D
1316
SIGNAL ALARM
PENDING ALARM
1326
SIGNAL ALARM
END

SMOKE DETECTOR

CROSS-REFERENCE TO RELATED APPLICATIONS

This application is a continuation of U.S. patent application Ser. No. 09/804,543 (now U.S. Pat. No. 6,326,897), entitled "SMOKE DETECTOR," by Applicants Brian J. Kadwell et al., filed Mar. 12, 2001, which is a continuation of U.S. patent application Ser. No. 09/456,470 (now U.S. Pat. No. 6,225,910), entitled "SMOKE DETECTOR," by Applicants Brian J. Kadwell et al., filed on Dec. 8, 1999, the entire disclosures of each are hereby incorporated herein by reference.

BACKGROUND OF THE INVENTION

The present invention relates to systems and methods for detecting smoke. Smoke detectors detect the presence of smoke particles as an early indication of fire. Smoke detectors are used in closed structures such as houses, factories, offices, shops, ships, aircraft, and the like. Smoke detectors may include a chamber that admits a test atmosphere while blocking ambient light. A light receiver within the chamber receives a level of light from an emitter within the chamber, which light level is indicative of the amount of smoke contained in the test atmosphere.

Several types of fires need to be detected. A first type is a slow, smoldering fire that produces a "gray" smoke containing generally large particles, which may be in the range of 0.5 to 1.2 microns. A second type is a rapid fire that produces "black" smoke generally having smaller particles, which may be in the range of 0.05 to 0.5 microns. Fires may start as one type and convert to another type depending on factors including fuel, air, confinement, and the like.

Two detector configurations have been developed for detecting smoke particles. Direct, or obscuration, detectors align the emitter and receiver such that light generated by the emitter shines directly into the receiver. Smoke particles in the test atmosphere interrupt a portion of the beam thereby decreasing the amount of light received by the emitter. Obscuration detectors typically work well for black smoke but are less sensitive to gray smoke. Additionally, obscuration detectors typically are not within a chamber, as they have an emitter and a receiver spaced at a substantial distance, such as one meter or across a room, whereas smoke detector chambers are preferably located within a compact housing. Indirect or reflected detectors, commonly called scatter detectors, have an emitter and receiver positioned on non-colinear axes such that light from the emitter does not shine directly onto the receiver. Smoke particles in the test atmosphere reflect or scatter light from the emitter into the receiver. Reflected detectors generally work well for gray smoke but have a decreased sensitivity to black smoke.

Smoke detectors typically use solid-state optical receivers such as photodiodes due to their low cost, small size, low power requirements, and ruggedness. One difficulty with solid-state receivers is their sensitivity to temperature. Additional circuitry that increases photo emitter current with increasing temperature partially compensates for temperature effects. Typical detectors also require complicated control electronics to detect the light level including analog amplifiers, filters, comparators, and the like. These components may be expensive if precision is required, may require adjustment when the smoke detector is manufactured, and may exhibit parameter value drift over time.

What is needed is a smoke detector with good sensitivity to both gray smoke and black smoke. The smoke detector should use a minimum of analog components to reduce cost and the possibility for component value drift over time. The smoke detector should also compensate for the effects of ambient temperature.

BRIEF DESCRIPTION OF DRAWINGS

The subject matter that is regarded as the invention is particularly pointed out and distinctly claimed in the claim portion that concludes the specification. The invention, together with further objects and advantages thereof, may best be understood by reference to the following description taken in conjunction with the accompanying drawings, where like numerals represent like components, and in which:

FIG. 13 is a flow chart illustrating operation of the controller for a smoke detector;

DETAILED DESCRIPTION OF THE DRAWINGS

A smoke detector detects both black and gray smoke with good sensitivity and reduced temperature sensitivity. The smoke detector has simplified control elements and is inexpensive to produce. The smoke detector includes a housing defining a dark chamber, the chamber admitting a test atmosphere. A light receiver is disposed within the chamber. A scatter emitter within the chamber is positioned such that light from the scatter emitter strikes the receiver when reflected off particles suspended in the test atmosphere. An obscuration emitter disposed within the chamber is positioned such that light emitted by the obscuration emitter is directed to the receiver unless obstructed by particles suspended in the test atmosphere. In one embodiment, the scatter emitter emits light with a first principal emission wavelength and the obscuration emitter emits light at a second principal emission wavelength less than the first principal emission wavelength. The presence of smoke may be determined based on the amount of reflected light received and the amount of directed light received. The smoke detector may include a controller having a discrete output and a sense input. A capacitor may be connected to the discrete output and to a current path extending from the light receiver. A voltage sense path connects the capacitor to the sense input. The controller turns on an emitter, asserts the discrete output to charge the capacitor, and deasserts the discrete output. The elapsed time between when the discrete output is deasserted and when the sensed voltage crosses a threshold voltage level is determined. The amount of light from the asserted emitter is determined based on the elapsed time. In a refinement, the controller turns off all emitters and determines one or more dark reference levels. The dark reference levels can be used to determine the amount of light received from the asserted emitters.

Figure 1:
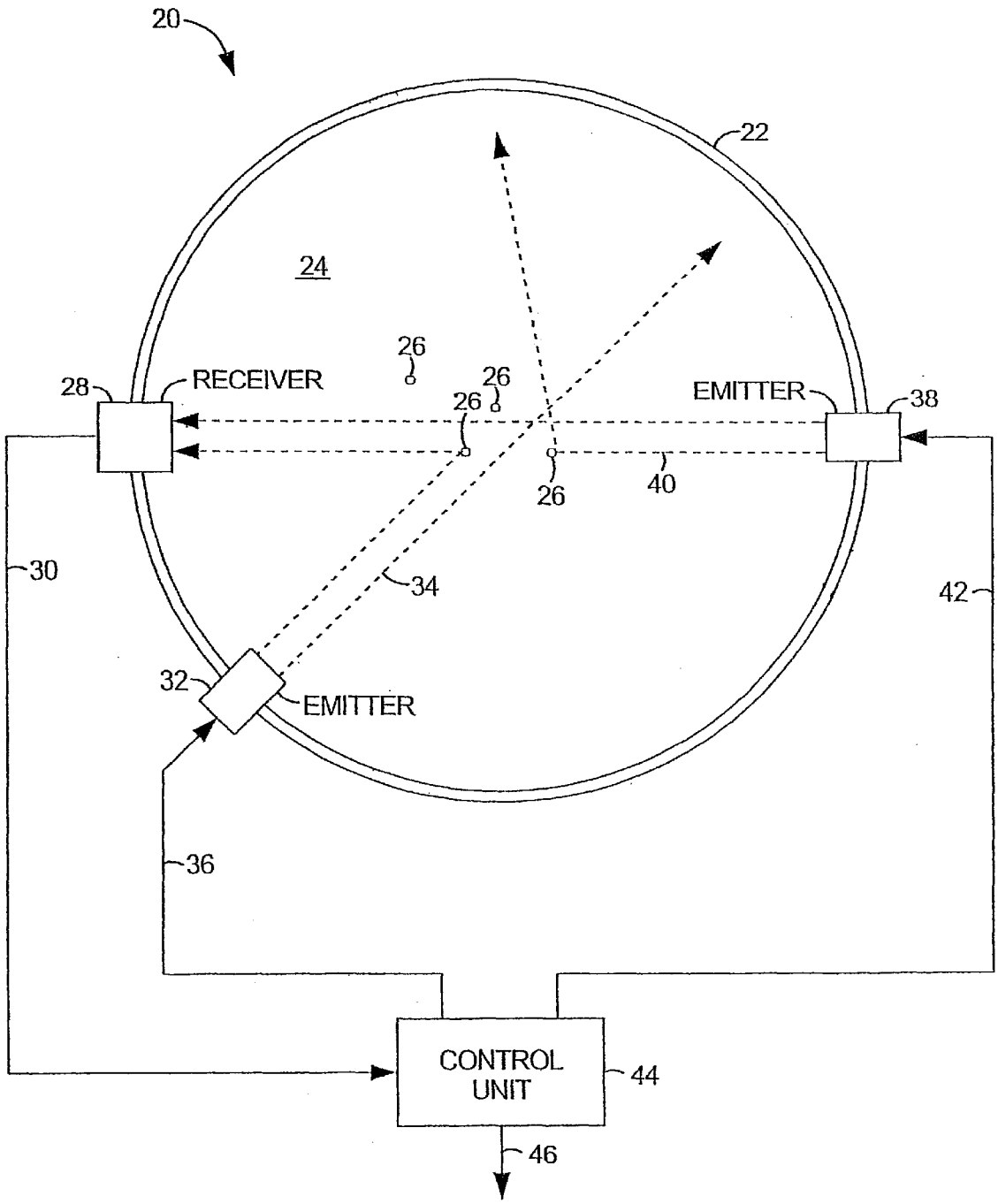
FIG. 1 is a schematic diagram illustrating a dual emitter smoke detector.

Referring to FIG. 1, a schematic diagram illustrating a dual emitter smoke detector, is shown. A smoke detector, shown generally by 20, includes housing 22 defining a dark chamber. The chamber admits test atmosphere 24 which may include smoke particles, some of which are shown and indicated by reference numeral 26. Smoke detector 20 includes receiver 28 generating a signal on receiver output 30 based on the intensity of light striking receiver 28. Scatter emitter 32 is positioned within the chamber such that emitted light 34 strikes receiver 28 if reflected off smoke particles 26 suspended in test atmosphere 24. Scatter emitter 32 is controlled by scatter emitter signal 36. Obscuration emitter 38 is positioned within housing 22 to generate light 40 that strikes receiver 28 unless obstructed by smoke particles 26 suspended in test atmosphere 24. Obscuration emitter 38 is controlled by obscuration emitter signal 42.

The combination of scatter emitter 32 and receiver 28 implements a scatter detector. The combination of obscuration emitter 38 and detector 28 effects an obscuration detector. Due to the generally differing sizes of black and gray smoke particles, smoke detection may be enhanced when obscuration emitter light 40 and scatter emitter light 34 have different principle emission wavelengths. For example, scatter emitter light 34 may be in the infrared range, or possibly a visible color light range, and obscuration emitter light 40 may be in a colored visible light range, such as blue, green, blue-green, red or violet light range. A visible color light emitter is preferable for the obscuration detector because the wavelength of such light is close to, or smaller than, the size of the black smoke particles, making the light easier for the black smoke particles to block, which is particularly advantageous for obscuration detectors having a short distance between the emitter 38 and the receiver 28. Whereas known obscuration detectors typically use white light transmitted over a substantial distance, such as one meter or the width of a room, the obscuration detector comprising emitter 38 and receiver 28 can be implemented in a small area, such as a smoke detector housing having a length, height and width, each substantially less than 12 inches, and preferably the longest dimension of such housing is less than 7 inches.

Smoke detector 20 includes control unit 44. Control unit 44 is coupled to receive output 30, and generates scatter emitter signal 36 and obscuration emitter signal 42. Control unit 44 is responsive to the receiver output 30 to generate a smoke detect signal at smoke detect signal output 46, based on receiver output 30, indicating the presence of smoke within test atmosphere 24. Smoke detect signal 46 may be used to activate one or more fire alarm devices, not shown, such as audible warning devices, warning lamps, fire department notification devices, and the like.

In operation, control unit 44 turns on scatter emitter 32. A first signal is received from receiver 28 indicating the amount of scatter emitter light 34 reflected from smoke particles 26. Control unit 44 is responsive thereto to determine the amount of reflected light received. Control unit 44 turns on obscuration emitter 38 and receives a second output signal from receiver 28 indicating the amount of directed light from obscuration emitter light 40 not blocked by smoke particles 26. Control unit 44 is responsive thereto to determine the amount of directed light received. Control unit 44 then determines the presence of smoke particles 26 in test atmosphere 24 based on the amount of reflected light received and/or the amount of directed light received. The duration of time that scatter emitter 32 is on may be dependent upon the amount of scatter emitter light 34 reflected to receiver 28. Likewise, the duration of time obscuration emitter 38 is on may be dependent upon the amount of obscuration emitter light 40 striking receiver 28. It is also envisioned that the scatter emitter and obscuration emitter can be controlled differently. For example, the scatter emitter may be on an amount of time dependent upon the amount of scatter emitter light 34 reflected to receiver 28 whereas the obscuration emitter on-time may be independent of the amount of obscuration emitter light 40 striking receiver 28.

Figure 2:
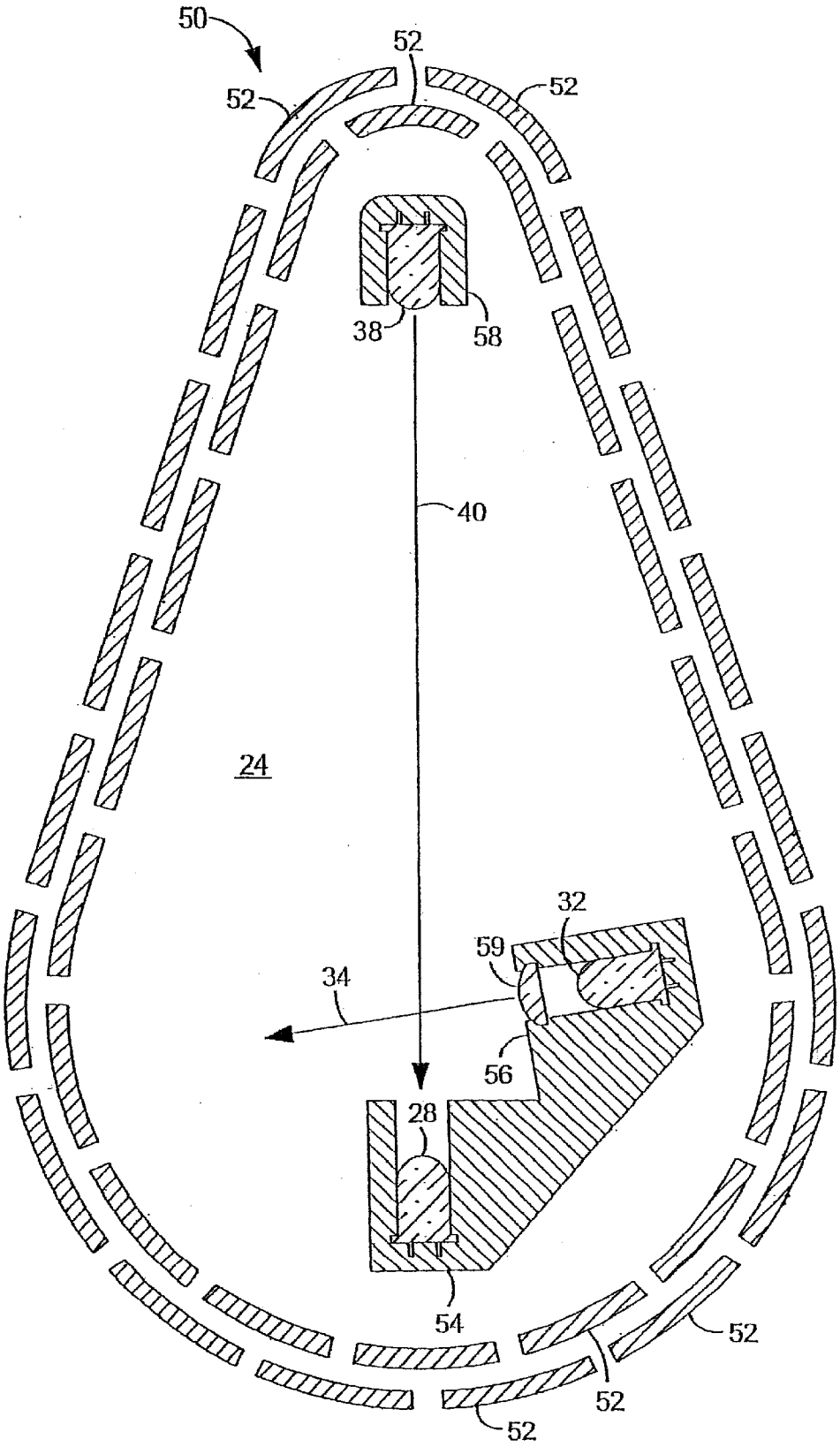
FIG. 2 is a schematic diagram illustrating emitter placement within a dual emitter smoke detector.

Referring now to FIG. 2, a schematic diagram illustrating emitter placement within a dual emitter smoke detector is shown. Smoke detector 20 includes a chamber, shown generally by 50, formed by overlapping light baffle 52 defining side walls and front and back walls (not shown), which together form a dark chamber for test atmosphere 24. Receiver 28 and scatter emitter 32 are held in receiver housing 54. Receiver housing 54 establishes the spacing and angle between receiver 28 and scatter emitter 32. Receiver housing 54 includes lip 56 at least partially blocking light from scatter emitter 32 so that none of scatter emitter light 34 directly strikes receiver 28. Emitter housing 58 holds obscuration emitter 38 across from receiver 28. The receiver housing 54 may be integrally molded with the front or back walls defining chamber 50.

Several design variations can optionally be employed to reduce the amount of direct light from scatter emitter 32 striking receiver 28. First, lens 59 may be used to focus light leaving scatter emitter 32. Lens 59 may be a separate element as shown, or it may be molded as part of the housing for scatter emitter 32. Second, scatter emitter 32 may be recessed in housing 54, as shown. Third, receiver 28 may be recessed in housing 54, as shown.

Figure 3:
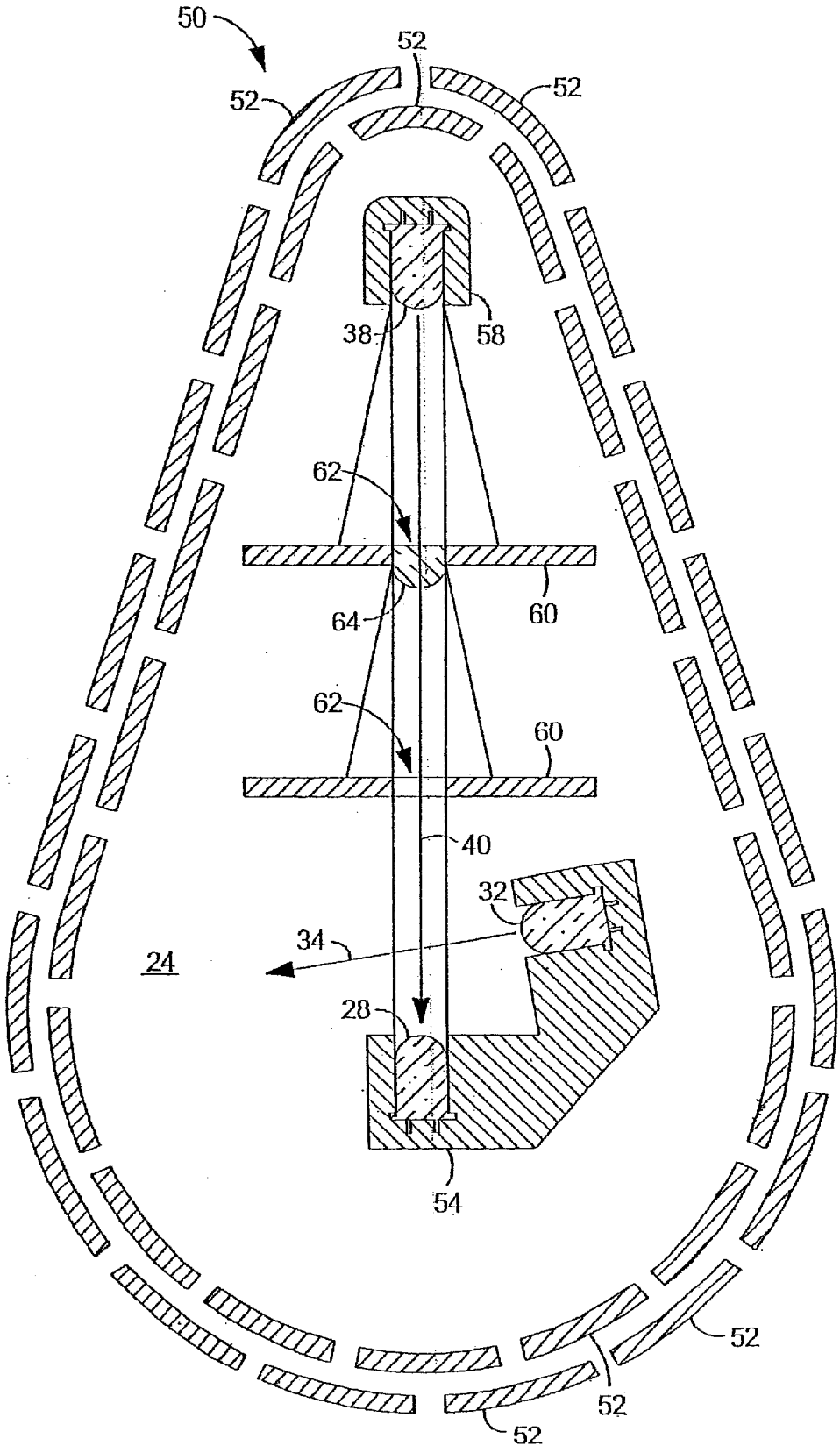
FIG. 3 is a schematic diagram illustrating the use of baffles in a dual emitter smoke detector.

Referring now to FIG. 3, a schematic diagram illustrating the use of baffles in a dual emitter smoke detector is shown. One or more baffles 60 are placed between receiver 28 and obscuration emitter 38. Each baffle 60 includes aperture 62 limiting the amount of obscuration emitter light striking receiver 28. Each aperture 62 may include lens 64 operative to focus light emitted by obscuration emitter 38 onto light receiver 28. The baffles 60 may be of any suitable construction, and may for example be plastic molded integrally with the housing comprising baffles 52, a front wall (not shown) and a back wall (not shown). These baffles 60 enhance the obscuration detector by reducing the amount of forward scatter reaching the receiver 28.

Figure 4:
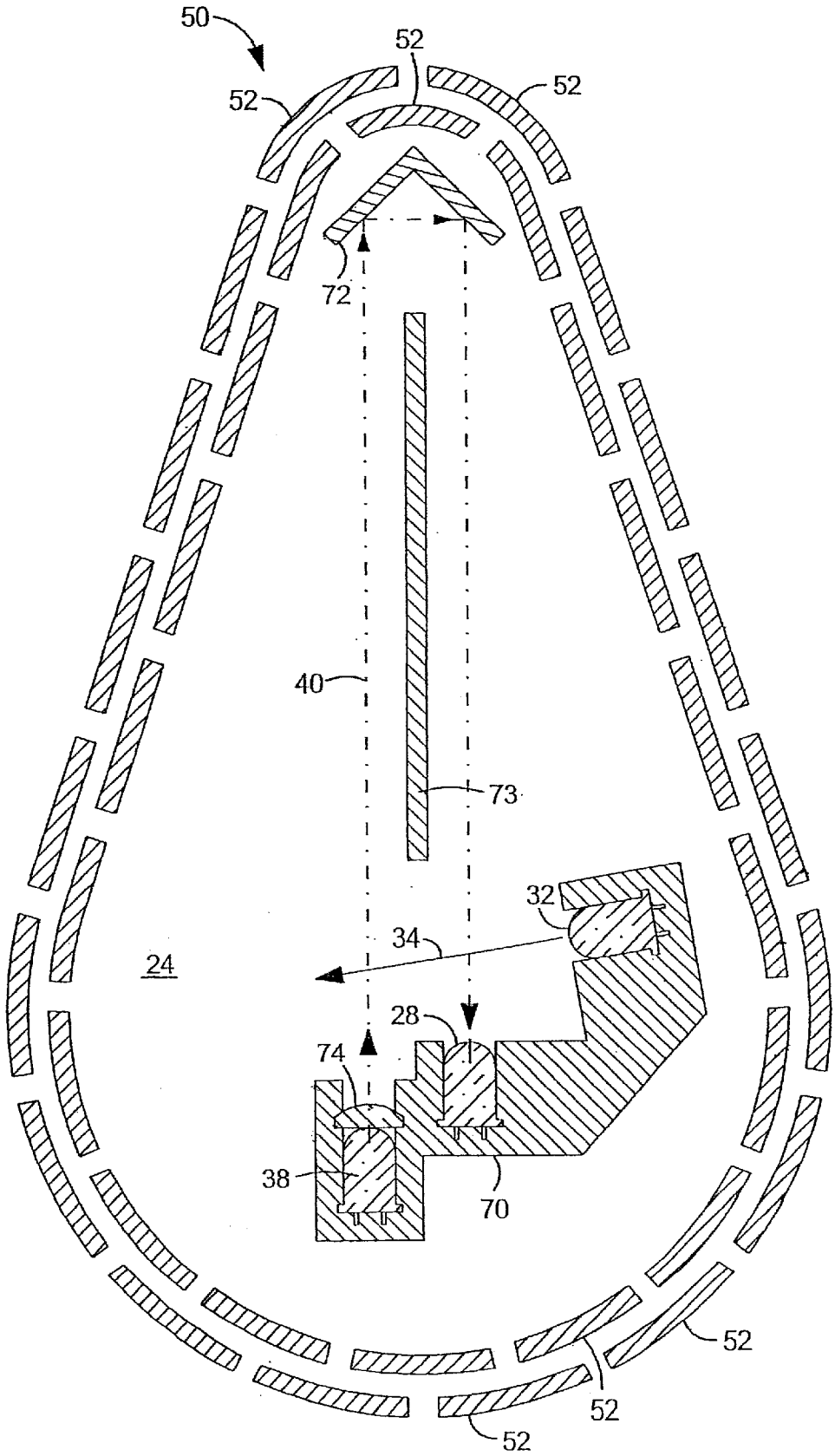
FIG. 4 is a schematic diagram illustrating emitter placement having an increased effective path for direct light.

Referring now to FIG. 4, a schematic diagram illustrating emitter placement providing an increased effective path for direct light is shown. Receiver housing 70 holds receiver 28, scatter emitter 32, and obscuration emitter 38. The length of the effective path that emitter light 40 travels in dark chamber 24 is approximately doubled using right angle mirror 72 to reflect light generated by the obscuration emitter 38 back to the adjacent receiver 28. The longer effective path length for obscuration emitter light 40 increases the smoke detector's sensitivity to black smoke. In the presence of smoke, light emitted by obscuration emitter 38 will be blocked by some smoke particles and reflected off of other smoke particles. The amount of light reflected will depend on the color of the smoke and the size of the smoke particles, as gray smoke will reflect more light than black smoke, for example. By increasing the length of the light path from emitter 38 to receiver 28, and selection of the emitter 38 to produce a desired light color, more light will be blocked by smoke particles and less reflected light will reach receiver 28. The resulting obscuration detector thus has an increased sensitivity to smoke. Housing 70 includes optional diffusing and collimating lens 74 positioned in front of obscuration emitter 38. Lens 74 smoothes the angular disparity of light leaving obscuration emitter 38 and controls the amount of obscuration emitter light 40 directed toward mirror 72. A vertical wall 73 may advantageously be inserted in parallel with the direct path traveled by light 40 to reduce the amount of light from emitter 32 reflected by mirror 72 that strikes receiver 28 during scatter detector operation.

Figure 5:
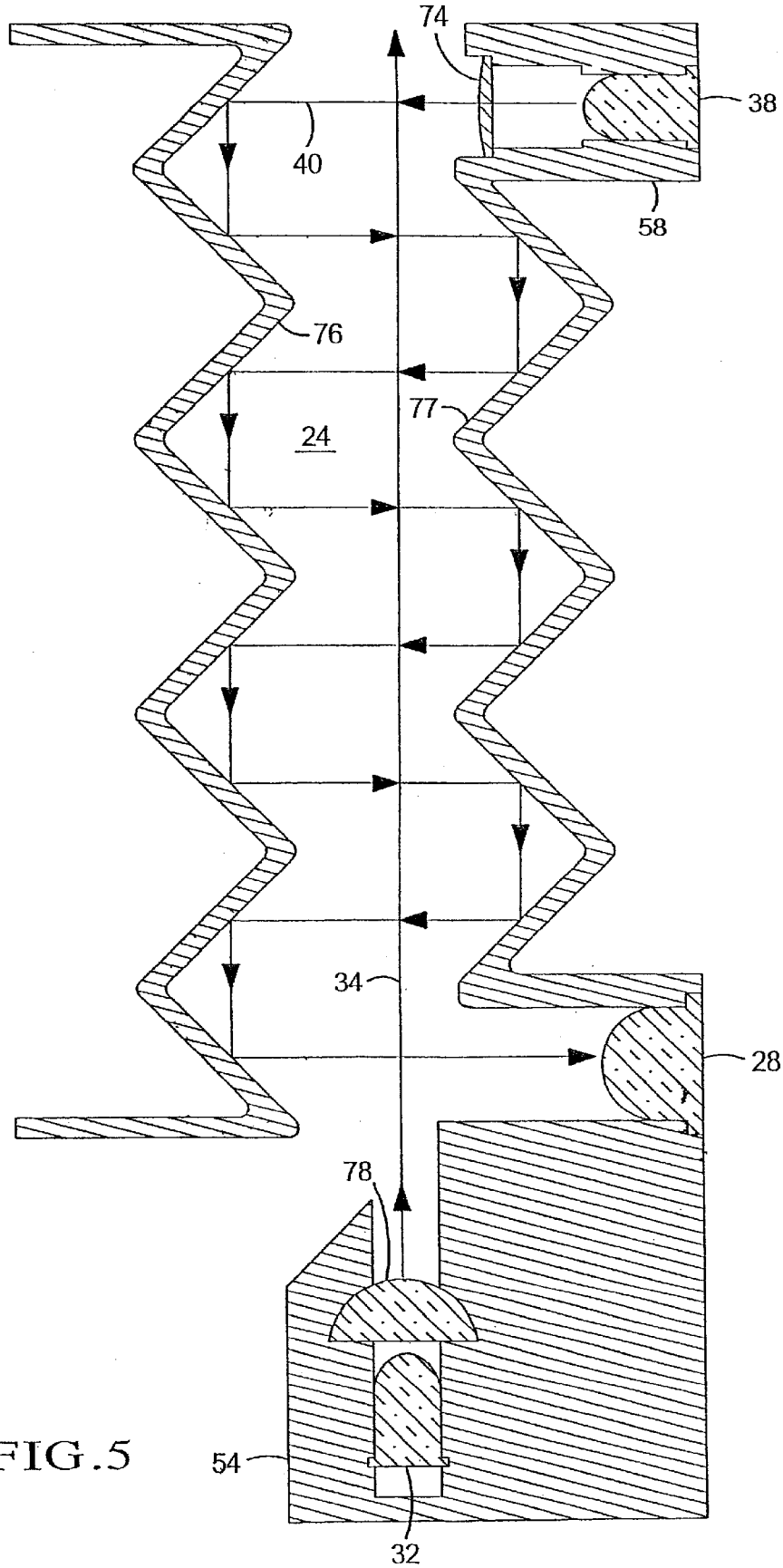
FIG. 5 is a schematic diagram illustrating opposing reflectors for increasing effective path for direct light.

Referring to FIG. 5, a schematic diagram illustrates opposing reflectors to increase the effective path length for direct light through the dark chamber 24. First reflective surface 76 includes a sequence of right angle reflectors. Opposing reflective surface 77 also includes a sequence of right angle reflectors. Reflective surfaces 76, 77 are positioned such that light from obscuration emitter 38 bounces alternately off first reflective surface 76 and opposing reflective surface 77, increasing the effective path of obscuration emitter light 40. Additionally, lens 78 controls the pattern of light 34 leaving scatter emitter 32.

Figure 6:
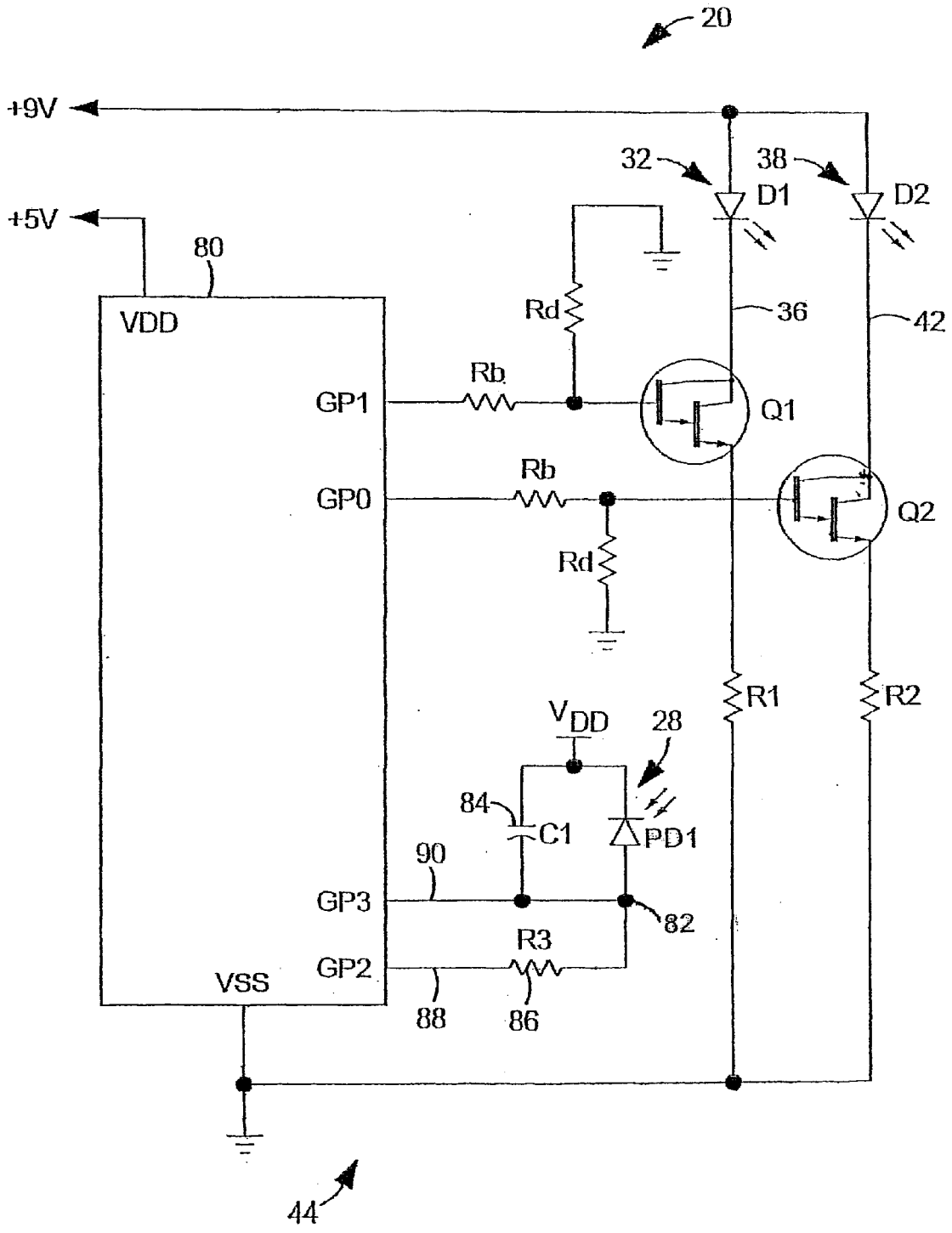
FIG. 6 is a schematic diagram of a control circuit for a dual emitter smoke detector.

Referring to FIG. 6, a schematic diagram of a control circuit for a dual emitter smoke detector. Control unit 44 includes a controller 80 which may be a microcontroller, a microprocessor, a digital signal processor, a programmable logic unit, or the like, and may, for example, be provided by part number PIC16CE624 commercially available from Microchip Technology Inc. of Chandler, Ariz. Scatter emitter 32, implemented as light emitting diode D1, is connected between a 9 Volt supply potential and the collector of transistor Q1. The base of transistor Q1 is connected to output GP1 of controller 80. The emitter of transistor Q1 is connected through resistor R1 to ground. Hence, output GP1 generates scatter emitter signal 36. Similarly, obscuration emitter 38, implemented as light emitting diode D2, is connected between a 9 Volt supply and the collector of transistor Q2. The base of transistor Q2 is connected to output GPO of controller 80. The emitter of transistor Q2 is connected through resistor R2 to ground. Hence, output GPO generates obscuration emitter signal 42. Each of transistors Q1 and Q2 may comprise NPN, PNP, PET or MOSFET elements, or the like, and may for example be a part number MPSA13 Darlington pair commercially available from Motorola, Inc. of Schaumburg, Ill. Heat sinking each transistor Q1, Q2 with its respective controlled emitter D1, D2 results in temperature compensation such that the amount of light generated by emitter D1, D2 is less dependent upon ambient temperature.

Receiver 28, implemented by photodiode PD1, is connected between supply voltage VDD and connection point 82. Capacitor C1, indicated by 84, is connected across receiver 28. Resistor R3, indicated by 86, joins connection point 82 with discrete output GP2 of controller 80, indicated by 88. Connection point 82 is also connected to sense input 90 of controller 80, labeled GP3. Preferably, sense input 90 is connected to a comparator, having an adjustable reference threshold, within controller 80. Although the receiver 28 and capacitor C1 are described as being connected between supply voltage VDD and connection point 82, it will be recognized that the capacitor C1 and receiver 82 can alternatively be connected in parallel between connection point 82 and ground.

In one embodiment, scatter emitter 32 has a principle wavelength between 850 and 950 nanometers and obscuration emitter 38 has a principle emission wavelength between 430 and 575 nanometers. For example, light emitting diode D1 can be implemented using an MIE-546A4U, emitting light at a principal wavelength of 940 nanometers, available from Unity Optoelectronics Technology of Taipei, Taiwan. Light emitting diode D2 may be an MVL-504B, emitting light at a principal wavelength of 470 nanometers, also available from Unity Optoelectronics Technology. The intensity of scatter emitter light 34 and obscuration emitter light 40 are dependent upon the values of resistors R1 and R2, respectively. In this example, the resistance of resistor R1 may be 7 Ω and the resistance of resistor R2 may be 16%. Photodiode PD1 may be, for example, a MID-56419, also available from Unity Optoelectronics Technology.

Figure 7:
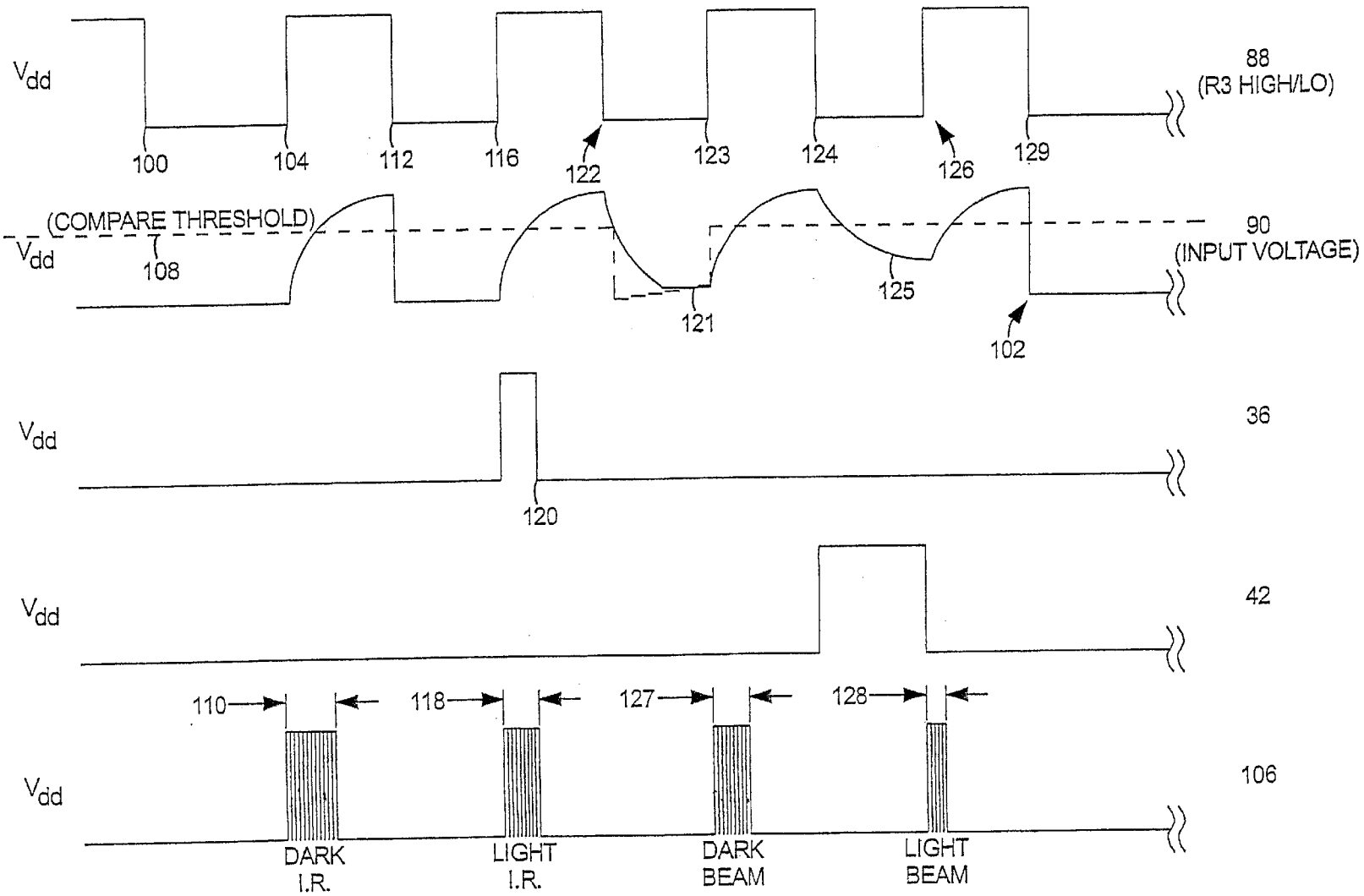
FIG. 7 is a timing diagram illustrating operation of a dual emitter smoke detector.

Referring now to FIG. 7, a timing diagram illustrates operation of a dual emitter smoke detector. The timing diagram shows one cycle during which the following timing measurements are made: a dark scatter reference; an elapsed scatter time that is based on scatter emitter light 34 impacting receiver 28; a dark obscuration reference; and an elapsed obscuration time that is based on the amount of obscuration emitter light 40 impacting receiver 28. The cycle is repeated periodically. Discrete output 88 toggles between supply voltage VDD and ground, and the sense input 90 toggles between floating and ground states. For convenience, asserting will refer to applying supply voltage $V_{DD}$ and deasserting will refer to grounding the terminal.

More particularly, discrete output 88 and sense input 90 are deasserted by connection to ground potential at time 100. This causes capacitor 84 to charge to approximately voltage VDD. Discrete output 88 is asserted at time 104, at which time sense input 90 is allowed to float, allowing the voltage across capacitor 84 to discharge through resistor 86. Discharge will also occur due to the dark current produced by receiver 28, connected in parallel to capacitor 84. Asserting discrete output 88, and permitting terminal 90 to float, triggers a counter within controller 80 to begin counting clock pulses, as indicated by counter signal 106. The counter is halted when sense input 90 crosses threshold voltage level 108. A comparator (not shown) internal to the controller compares the signal level on sense input 90 to a programmable reference level 108, which is set to a default level during most of the measurement cycle. The dark scatter reference 110 is the elapsed time between when discrete output 88 is asserted and when sense input 90 crosses threshold voltage level 108, and indicates a dark current reference level of receiver 28. This dark scatter reference 110 is used in the scatter detector measurement as described herein below.

Discrete output 88 and sense input 90 are deasserted at time 112, causing charging of capacitor 84. Discrete output 88 is asserted at time 116, at which time sense input 90 is permitted to float. At the same time, scatter emitter signal 36 is asserted, turning on scatter emitter 32. The rate of discharge of capacitor 84 is dependent upon the amount of scatter emitter light 34 striking receiver 28, as the capacitor 84 will discharge both through resistor 86 and due to the current through receiver 28. Asserting discrete output 88 begins a counter within controller 80, as indicated by counter signal 106. The counter is turned off when sense input 90 crosses threshold voltage level 108. The elapsed scatter time 118, which is the elapsed time between asserting discrete output 88 and when sense input 90 crosses threshold voltage level 108, is dependent upon the amount of scatter emitter light 34 striking receiver 28. The more reflective smoke particles that are present, the more light from scatter emitter 32 that will strike receiver 28, the more current that will be drawn through the receiver 28, and the shorter the time required to discharge the capacitor 84 to the point that the sense input 90 crosses threshold voltage level 108. Scatter emitter signal 36 may be deasserted at time 120, following the elapsed scatter time 118, such that the scatter emitter is turned off when the sense input 90 crosses threshold 108.

At time 122 the output 88 is deasserted and the sense input 90 continues to float. The voltage level on the sense input 90 will drop to a level 121, which is proportional to the magnitude of the dark current present at receiver output 30, after an appropriate settling time for capacitor 84. The settling time is selected to be the maximum amount of time expected for the capacitor to become substantially settled, and may for example be approximately 10 to 15 milliseconds. The internal comparator's reference threshold 108 is programmable to 1 of 32 different voltage levels. The magnitude range for the dark current is determined using this programmable threshold. Initially, threshold 108 is set to its lowest programmable value, and once the capacitor settling time has elapsed, a comparison is made to determine whether the voltage present on input 90 is higher than this lowest programmable level. If it is not, then the dark current magnitude is in the lowest range. If, however, the voltage present at input 90 is higher than the lowest programmable level, the reference level 108 is incremented to its next level. If the voltage present on sense input 90 is higher than the incremented reference level 108, the reference level is incremented again, to the next programmable reference level. The sense input is then compared to that reference level. The process of incrementing the reference level to its next sequential level, and comparing the voltage on sense input 90 to that incremented sequential reference level, will be repeated until the level on input 90 is lower than the reference level 108 or the highest reference voltage is reached. The level to which threshold 108 must be raised in order to exceed the signal level on input 90 is the obscuration dark current reference level, and it is stored for later use in selecting an adjustment factor as described in greater detail herein below. The adjustment factor is used to compensate for temperature variations, thereby enhancing the accuracy of obscuration detector measurements made over a wide temperature range.

At time 123, threshold 108 is returned to its default value, discrete output 88 is asserted, permitting capacitor 84 to discharge, and the counter begins counting, as indicated by counter signal 106, while obscuration emitter signal 42 remains deasserted (i.e., emitter 38 is off). The counter is turned off when sense input 90 crosses voltage threshold 108. The dark obscuration reference 127, which is the elapsed time between asserting discrete output 88 and when sense input 90 crosses threshold 108, is a reference dark current time count for obscuration emitter 38. This dark obscuration reference 127 is used in the obscuration detector measurement as described herein below.

At time 124, discrete output 88 is deasserted, the sense input 90 continues to float, and obscuration emitter signal 42 is asserted. Consequently, capacitor 84 begins charging at the same time as obscuration emitter 38 turns on. The capacitor 84 will charge to a potential such that the sense input 90 settles at voltage level 125, which voltage level is dependent upon the amount of light striking the light receiver 28. If no smoke is present, the emitter light 40 reaches receiver 28 without substantial blockage, inducing a large current in receiver 28, resulting in a high voltage level 125 at time 126. When more smoke is present, less emitter light 40 reaches receiver 28, allowing the sense input 90 to reach a lower voltage 125 at time 126. At time 126, discrete output 88 is asserted, while sense input 90 floats, and the obscuration emitter is turned off, causing capacitor 84 to discharge through resistor 86 and receiver 28. The time required for the capacitor to discharge to the point that sense input 90 crosses threshold 108 is inversely related to the amount of emitter light 40 striking receiver 28 between time 124 and time 126. As noted above, the more smoke present while the obscuration emitter is on, the lower the voltage 125 at sense input 90. The lower the voltage at time 126, the more time will be required to discharge capacitor 84 to the point that the sense input 90 crosses above threshold voltage level 108. The measurement of elapsed obscuration time 128 is initiated upon deasserting discrete output 88. At that time, a counter within controller 80 begins counting, as indicated by counter signal 106. The counter is turned off when sense input 90 crosses threshold voltage level 108. The elapsed obscuration time 128, between asserting discrete output 88 and when sense input 90 crosses over threshold voltage level 108, indicates the amount of obscuration emitter light 40 striking receiver 28 during the interval from time 124 to time 126. Preferably, measurements 110, 118, 127 and 128 are taken within a short period of time to properly compensate for dark current in receiver 28. Elapsed obscuration time 128 is used in the obscuration detector measurement as described herein below.

Although not illustrated, it will be recognized that the length of time required to complete each measurement cycle can be reduced. Those skilled in the art will appreciate that if the times 112, 122, 124 and 129 are preset, the time period between asserting and deasserting the output 88 must be longer than the longest expected time required for the voltage on sense input 90 to cross threshold 108. To reduce the cycle time, the time periods 112, 122, 124 and 129 are set dynamically as follows. As soon as the sense input 90 crosses the threshold 108, the control input 88 is deasserted. As a consequence, the times 112, 122, 124 and 129 need not be set in advance, and they will occur at the earliest possible time for actual measurement conditions.

Figure 11:
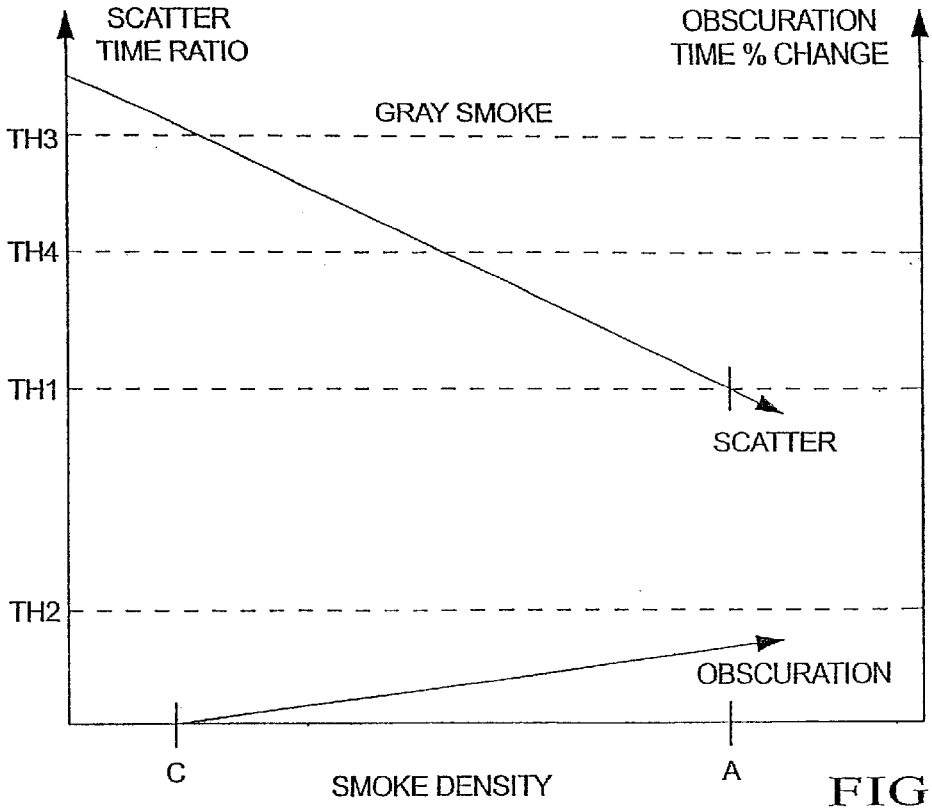
FIG. 11 is a chart illustrating the operation of the dual emitter smoke detector when gray smoke is present.
Figure 12:
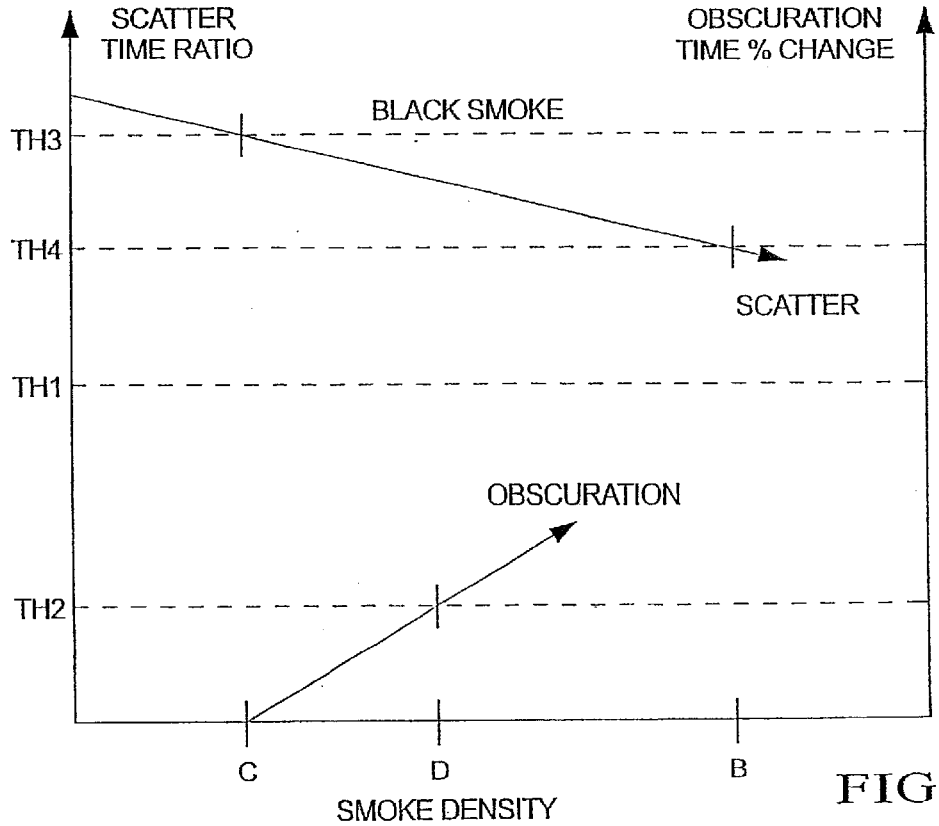
FIG. 12 is a chart illustrating the operation of a dual emitter smoke detector when black smoke is present.

The operation of smoke detector 20 will now be described with reference to FIGS. 6, 7, and 11 through 13. FIGS. 11 and 12 graphically illustrate the operation of the obscuration detector, using emitter 38 and receiver 28, and the scatter detector, using emitter 32 and receiver 28, when gray smoke and black smoke are present in the dark chamber. FIG. 13 is a flow chart illustrating a smoke detector sensor cycle implemented under the control of controller 80. The trapezoid boxes that are not numbered are comments provided to assist understanding, and are not steps in the operation of controller 80. In each sensor cycle, the dark scatter tine 110 is measured, as described above, in step 1300. The scatter emitter 32 is energized at time 116, as indicated in step 1302, and the elapsed scatter time 118 is then measured, as described above, as indicated in step 1304. The scatter ratio, which is the ratio of the elapsed scatter time 118 to the dark scatter reference 110, is compared to a threshold TH3. As can be seen in FIG. 11, in the presence of gray smoke, the time required for the capacitor 84 to discharge while scatter emitter 32 generates light quickly decreases as the density of the smoke particles increases. This occurs because the amount of light from emitter 32 that strikes the receiver 28 after being reflected off of the smoke particles increases with increasing gray smoke density. This comparison to threshold TH3 is made to determine whether the obscuration level is expected to be above or below 0.6%. If the scatter detector measurement is above threshold TH3, the cycle interval will be set to a long interval as indicated in step 1320, and the cycle ends.

If the scatter emitter is below threshold TH3 (point C in FIGS. 11 and 12) as determined in step 1306, the dark obscuration reference 127 is measured, as indicated in step 1309. The initial conditions are set using obscuration emitter 38, as indicated in step 1310. The initial conditions are set by turning the obscuration emitter 38 on and letting the capacitor 84 settle to a level 125. The elapsed obscuration time 128 is measured, in step 1312, by turning the emitter 38 off and measuring how long it takes for the voltage at terminal 82 to cross threshold 108. In step 1314, the state of the cycle interval is evaluated. If the cycle interval is long, the obscuration reference is set to the difference between the elapsed obscuration time 128 and the dark obscuration reference 127, as indicated in step 1317. This is the reference level taken at point C, as it is the first time the obscuration measurement is made after the scatter ratio crosses threshold TH3. Additionally, the short cycle interval is set in step 1318, so that measurements will be taken more often. The controller 80 then determines whether the obscuration percentage change is below threshold TH2 in step 1322. If it is, the controller 80 will determine whether the scatter ratio dropped below the threshold THI, as indicated in step 1308, while emitter 32 is generating light. If it has dropped below TH1, the smoke detect signal is generated as indicated in step 1316. A suitable alarm, such as an audible, visual, and/or electrical signal can then be generated.

If it is determined in step 1308 that the scatter ratio has not dropped below threshold TH1, although it is below TH3, and the obscuration measurement is below threshold TH2 as determined in steps 1306 and 1322, the smoke detector enters a pending alarm state and the cycle ends.

If it is determined in step 1322 that the obscuration percentage change is greater than thresho Dec. 3, 2001 ld TH2, the scatter emitter ratio is compared to a threshold TH4, in step 1324. If the scatter time ratio is above TH4, the alarm condition continues to be pending, such that the measurement cycle is repeated more often, and the cycle ends. If the scatter ratio is below threshold TH4, an alarm detect signal is made, as indicated in step 1326, and the 1 cycle ends. As can be seen from FIGS. 11 and 12, when gray smoke is present, the time required for capacitor 84 to discharge while emitter 32 is generating light decreases much more quickly than when black smoke is present. As a consequence, the scatter detector will require a greater smoke density to cross the threshold TH1 in the presence of black smoke, as compared to gray smoke. The smoke detector 20 uses the obscuration detector measurement to alter the scatter emitter threshold to TH4 to enable the smoke detector to react more quickly. In the presence of gray smoke, the scatter ratio will cross threshold TH1 well before the obscuration difference crosses threshold TH2. In the presence of black smoke, however, the obscuration difference crosses threshold TH2 for a lower smoke density than that where the scatter ratio crosses threshold TH1. The smoke detector thus permits dynamic adjustment of the scatter emitter threshold from TH1 to TH4 to allow faster reaction by the scatter detector in the presence of black smoke.

Although the scatter detector and obscuration detector can operate independently, several advantages are gained by using them together as described above. For example, the short length of the obscuration detector light path from emitter 38 to receiver 28 affects its sensitivity. By using the scatter detector threshold TH3 as a precondition to using the obscuration detector, the reliability of the obscuration detector is increased despite the relatively short length of the path for obscuration detector light 40. Using the obscuration detector to reset the scatter emitter alarm threshold to TH4 improves the scatter detector's sensitivity in the presence of black smoke while helping to avoid false alarms which would result if the scatter detector threshold is always low. Additionally, the scatter emitter can operate alone during most cycles as the obscuration detector need only be used after the scatter detector ratio reaches threshold TH3. This reduces the overall current drain of the smoke detector under non-alarm conditions, which is particularly important for battery-operated smoke detectors.

It is envisioned that the smoke detector sensor cycle will be repeated periodically, and that each cycle will last for a very short period of time. For example, the cycle may be repeated once every 5 to 45 seconds, and can for example occur once every 8 seconds. The cycle may last between 0.05 and 0.2 second, and may for example last approximately 0.1 second. The timing of the cycle is chosen to reduce power consumption without detrimentally impacting the response time of the smoke detector. Additionally, it is envisioned that the cycle will be repeated at a higher rate, set in step 1318, such as once every 1 to 5 seconds, when the scatter ratio drops below threshold TH3, until the scatter ratio rises above threshold TH3, as determined in step 1306, at which time the interval between sampling cycles will be reset to the longer interval in step 1320, such as the exemplary once every 8 seconds interval described above.

An example of how the thresholds TH1–TH4 can be selected will now be provided.

The threshold TH1 can be selected as follows. A scatter detector is placed in gray smoke having a density that causes a UL beam to detect approximately 2.5% obscuration/foot. "UL beam" refers to a beam detector test performed according to Underwriter's Laboratory (UL) test standards, such as UL268. The scatter detector measurement is made. The scatter detector measurement in that smoke density is used for the threshold TH1 of the smoke detector. The threshold TH3 is selected in a similar manner. The scatter detector is placed in gray smoke having a density such that UL beam will detect approximately 0.6% obscuration/foot. The scatter detector measurement in that density of smoke is threshold TH3. Threshold TH4 is also selected in the same manner. The scatter detector is placed in gray smoke having a density such that a UL beam will detect approximately 1.25% obscuration foot. The scatter detector measurement in that smoke density is the threshold TH4 for the smoke detector. The threshold TH2 is selected to correspond to approximately a 4% light reduction, which due to the short path length for light 40, corresponds to approximately 6% obscuration foot in the presence of black smoke as measured by a UL beam. For a new smoke detector operating using these thresholds in the presence of black smoke, the light from the obscuration emitter 38 is expected to be at approximately 98% of full intensity when it impacts receiver 28 at the time when the scatter detector ratio crosses threshold TH3. As long as the scatter detector detects at least this level of smoke, the obscuration emitter 38 will continue to operate, and the sensing cycle will be repeated at the higher repetition rate. When threshold TH2 is exceeded the detector will change the scatter detector alarm threshold to be more sensitive, by using threshold TH4 instead of threshold TH1. Those skilled in the art will recognize that the thresholds are merely exemplary, and that other thresholds could be used. Additionally, smoke detectors can be tailored for use in controlled environments by the selection of the threshold levels. For example, if the smoke detector is intended for use in a controlled environment where fuels (e.g., gasoline or kerosene) are stored, such that fires are expected to always have a high black smoke content, the thresholds TH1–TH3 can be selected such that the smoke detector is more sensitive to black smoke without producing excessive false alarms. Those skilled in the art will also recognize that the actual smoke density thresholds for any particular smoke detector can vary due to aging of the smoke detector, environmental conditions, part tolerances, and the like.

It is further envisioned that instead of having two unique alarm thresholds, TH1 and TH4, the alarm threshold could be proportionally adjusted by the amount of black smoke composition present, (i.e. TH4'=f(Scatter, Obscuration). To obtain an alarm at a consistent smoke density the function f(Scatter, Obscuration) can be implemented using a table-lookup. The following 5 point table 1 is provided as an example.

TABLE 1

| Scatter | Obscuration |
|---|---|
| 1.25 | 4 |
| 1.56 | 3.16 |
| 1.87 | 2.5 |
| 2.18 | 1.78 |
| 2.5 | 1.1 |

Figure 15:
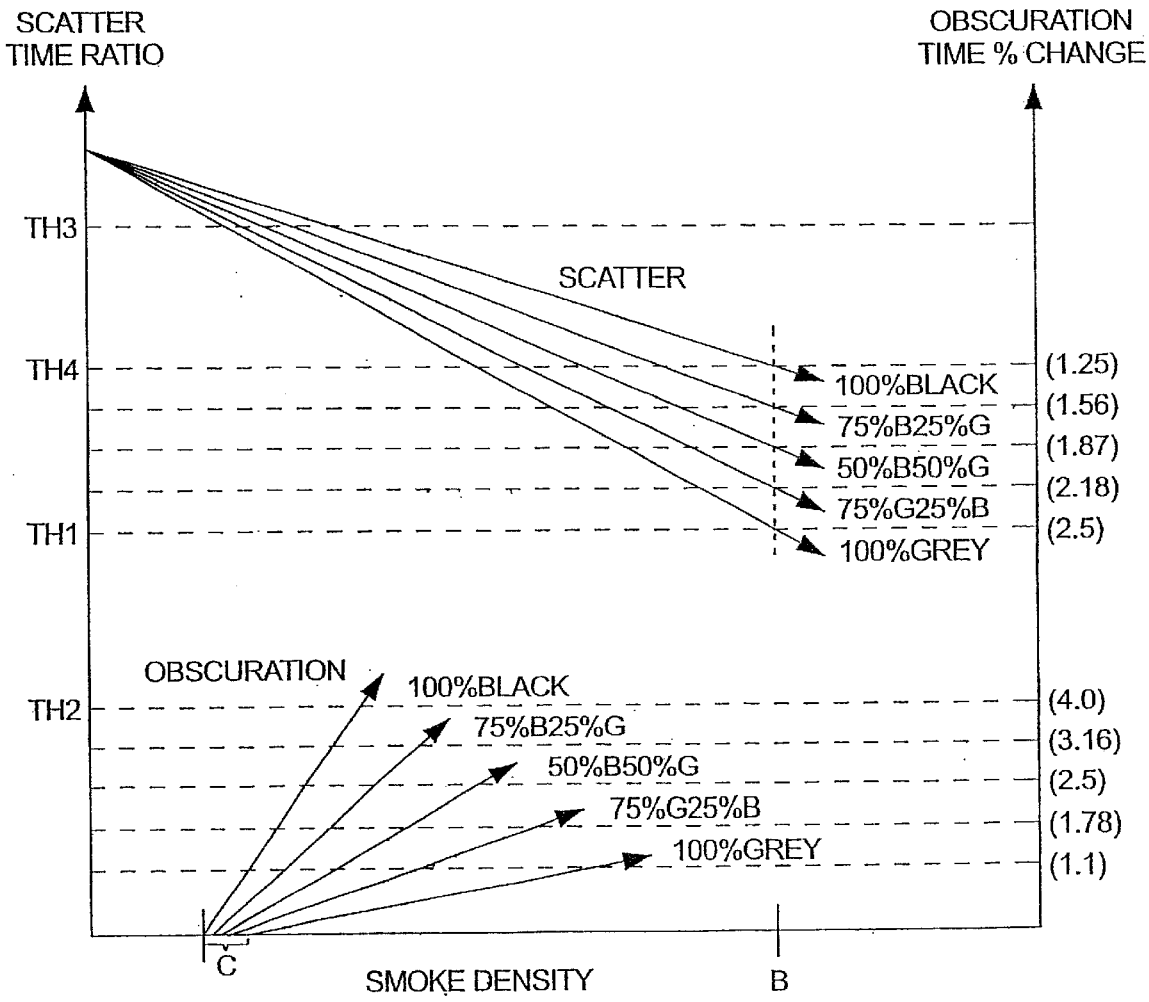
FIG. 15 is a chart illustrating a smoke detector including additional dynamic scatter detector measurement thresholds.

The table represents the smoke detect threshold level TH1 or TH4' for the scatter detector as the obscuration detector % change measurements changes. Thus, when the obscuration measurement detects a 1.1 percent change, the scatter emitter threshold will be TH1. As mentioned above, TH1 is the scatter emitter measurement taken in a smoke density that produces a 2.5 percent obscuration in a UL beam measurement. As the obscuration measurement rises, the smoke detect threshold for the scatter detector rises. When the obscuration detector measurement crosses 1.78 percent change, the scatter emitter threshold is raised to TH4'. For this obscuration measurement, TH4' is a scatter emitter measurement taken in a smoke density that produces a 2.18 percent obscuration in a UL beam measurement. When the obscuration detector measurement crosses 2.5 percent change, the scatter emitter threshold is raised to the next threshold TH4'. For this obscuration measurement, TH4' is a scatter emitter measurement taken in a smoke density that produces a 1.87 percent obscuration in a UL beam measurement. When the obscuration detector measurement crosses 3.16 percent change, the scatter emitter threshold is raised to the next threshold TH4'. For this obscuration measurement, TH4' is a scatter emitter measurement taken at a smoke density that produces a 1.56 percent obscuration in a UL beam measurement. When the obscuration detector measurement crosses 4 percent change, the scatter emitter threshold is raised to the next threshold TH4'. For this obscuration measurement, TH4' is a scatter emitter measurement taken in a smoke density that produces a 1.25 percent obscuration in a UL beam measurement. Thus it can be seen that as the obscuration measurement rises, the scatter detector smoke detect threshold rises proportionally. In operation, if the scatter measurement corresponds to a smoke level of greater than 2.5% obscuration/foot as measured by the UL beam, then an alarm would be generated regardless of the obscuration detector measurement as the threshold for the scatter detector measurement will be TH1. For scatter measurements that indicate a smoke level of less than 2.5% obscuration/ft, as measured by the UL beam, the alarm would be generated based on the evaluation of TH4'=f (Scatter, Obscuration). The different measurement thresholds TH4' permit the smoke detector to produce a smoke detect signal in approximately the same smoke density (reference B in FIG. 15) regardless of the percentage of black and gray smoke. The reference levels are selected such a smoke detect signal will be generated at point B for reference level TH1 if the smoke has 0% black smoke. The respective reference levels for TH4' are selected such a smoke detect signal will be generated at density B in FIG. 15 for: 25% black smoke; 50% black smoke; 75% black smoke; and 100% black smoke. It will be recognized that scatter threshold can alternately be generated as a direct function of the slope of the obscuration detector measurement.

The control system described with regards to FIGS. 6 and 7 may be adapted to any number of emitters. The signal to noise ratio is an important consideration in selecting the threshold 108. Threshold 108 is selected as permitted by the controller 80 so that substantial voltage changes do not produce small time differences. However, if the threshold voltage level 108 is too large, even very small variations in the voltage will result in substantial time differentials, such that the circuit will be highly susceptible to noise. It is envisioned that the threshold voltage 108 can be more than half of the supply voltage VDD used to charge the capacitor, and more particularly on the order of $\frac{7}{8}^{th}$ of the voltage VDD. As noted above, the voltage is supplied to one input of an internal comparator, the other input of which is connected to sense input 90. It is envisioned that a different threshold voltage level 108 may be used to determine the dark reference level and the light levels from each emitter 32, 38. For example, the threshold 108 for the scatter detector may be lower than the threshold 108 for the obscuration detector to account for the lower signal-to-noise ratio in the signal received from scatter emitter 32.

In one embodiment a ratio of the received emitter light to the dark reference level at different times is used to compensate for variations in the value of capacitor 84, and some of the affects of aging and temperature. A first ratio of the received emitter light 34, 40 to the dark reference level under no smoke conditions is stored in controller 80. During use, a new ratio of received emitter light 34, 40 to the dark reference level is obtained. In particular, the calibrated measurement ratio used can be:

$$(T_{118}/T_{110})/(T_{118Ref}/T_{110Ref}),$$

where $T_{118}$ is the measured elapsed scatter time 118 and $T_{110}$ is the measured dark scatter reference 110 time at a sampling time, and $T_{118Ref}$ is the elapsed scatter time 118 and $T_{110Ref}$ is the dark reference for a stored reference level. In particular, the reference ratio $T_{118Ref}/T_{110Ref}$ is a stored calibration value representing a no smoke condition. This ratio of ratio represents the percentage of smoke present. An initial reference ratio value can be set and stored for the scatter and/or obscuration detector when the smoke detector is manufactured. Over time, the reference ratio can be altered to reflect changing performance characteristics of the smoke detector components, and to compensate for the presence of dirt, such as dust, in the dark chamber. These adjustments can be made by incremental compensation of the reference ratio in proportion to the gradual drift in measured ratios that do not produce an alarm indication. Thus, if the measured scatter and obscuration ratios at different sampling times drift up or down over a period of time, the associated reference thresholds can be adjusted to a higher or lower value to reflect that drift. Adjustments in the reference ratio would not be made for those measurement that result in a pending alarm or actual alarm condition. By using a ratio of the new received light-to-dark level ratio and the old light-to-dark level ratio removes the effects of long-range drift in capacitor 84 and compensates for temperature variations, which affects are cancelled by the ratio.

Variations in the characteristics of the obscuration detector may also be compensated for automatically. The obscuration detector uses a percent change calculation to detect a pending alarm condition. In particular, the following relationship is used:

$$(O_{Ref}-O_{Dif})/O_{Ref}$$

where $O_{Ref}$ is an obscuration reference and $O_{Dif}$ is an obscuration difference. The obscuration difference is $T_{127}-T_{128}$. The obscuration reference is the obscuration difference recorded when the scatter measurement crosses threshold TH3. By using a percentage change threshold, instead of an absolute measurement, variations in the performance of the emitter 38 and the receiver 28, whether caused by temperature variations, aging, dirt, or the like, can be compensated for during measurement.

Many configurations for sensing received light are possible. Each of these configurations includes controller 80 having discrete output 88 and sense input 90. In some implementations, discrete output 88 and sense input 90 share a common input/output port. Capacitor 84 is connected to discrete output 88. A path for current extends between capacitor 84 and light receiver 28. A voltage sense path extends from capacitor 84 to sense input 90. In these embodiments, the sense input is allowed to float while the discrete output changes from VDD to ground, for example.

Figure 8:
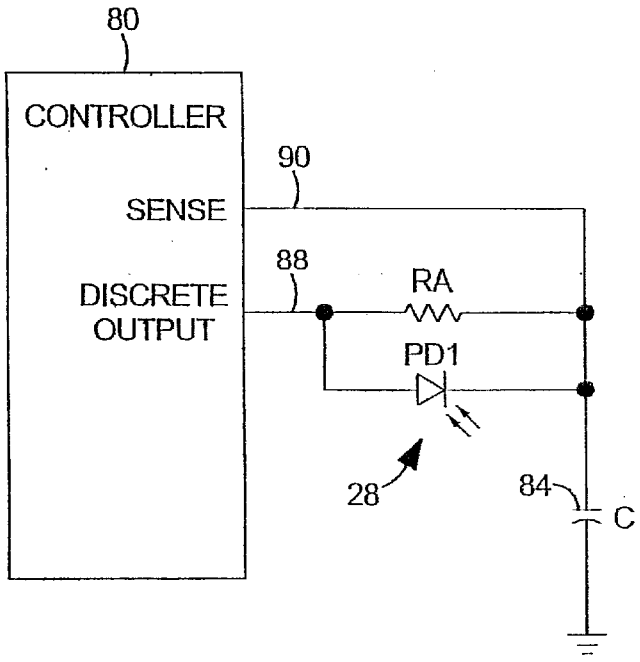
FIG. 8 is a schematic diagram of a light receiver driving and sensing circuit.

Referring now to FIG. 8, a schematic diagram of a light receiver driving and sensing circuit according to an alternate embodiment is shown. Resistor RA is connected in parallel with receiver 28 between discrete output 88 and capacitor 84. Capacitor 84 is directly connected to sense input 90. Capacitor 84 is connected to ground. It will be recognized that the signals 88 and 90 will be inverted relative to the signals in FIG. 7, and further that the sense input 90 can float throughout the sensing cycle.

Figure 9:
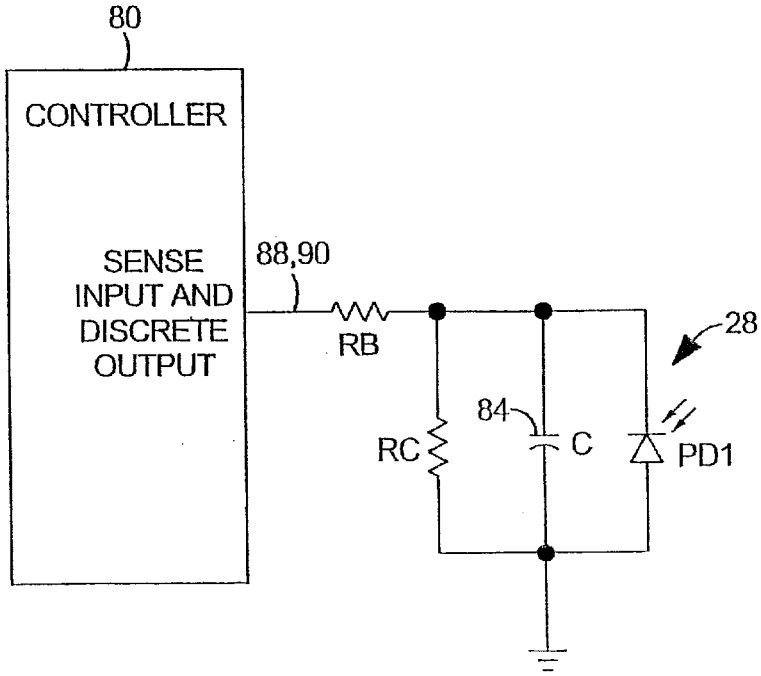
FIG. 9 is a schematic diagram of a light receiver circuit with a combined driving and sensing port.

Referring now to FIG. 9, a schematic diagram illustrates a light receiver circuit with a combined driving and sensing port according to another embodiment. Resistor RB is connected between combined discrete output 88 and sense input 90 and the parallel combination of resistor RC, receiver 28, and capacitor 84. In this embodiment, it is envisioned that the voltage VDD will be applied to terminal 88, 90 during charging and that terminal 88, 90 will float otherwise. Thus, terminal 88, 90 is indicative of the capacitor voltage, which over time is dependent upon the rate at which current is discharged by the capacitor 84, which is in turn dependent on the current in the receiver 28.

Figure 10:
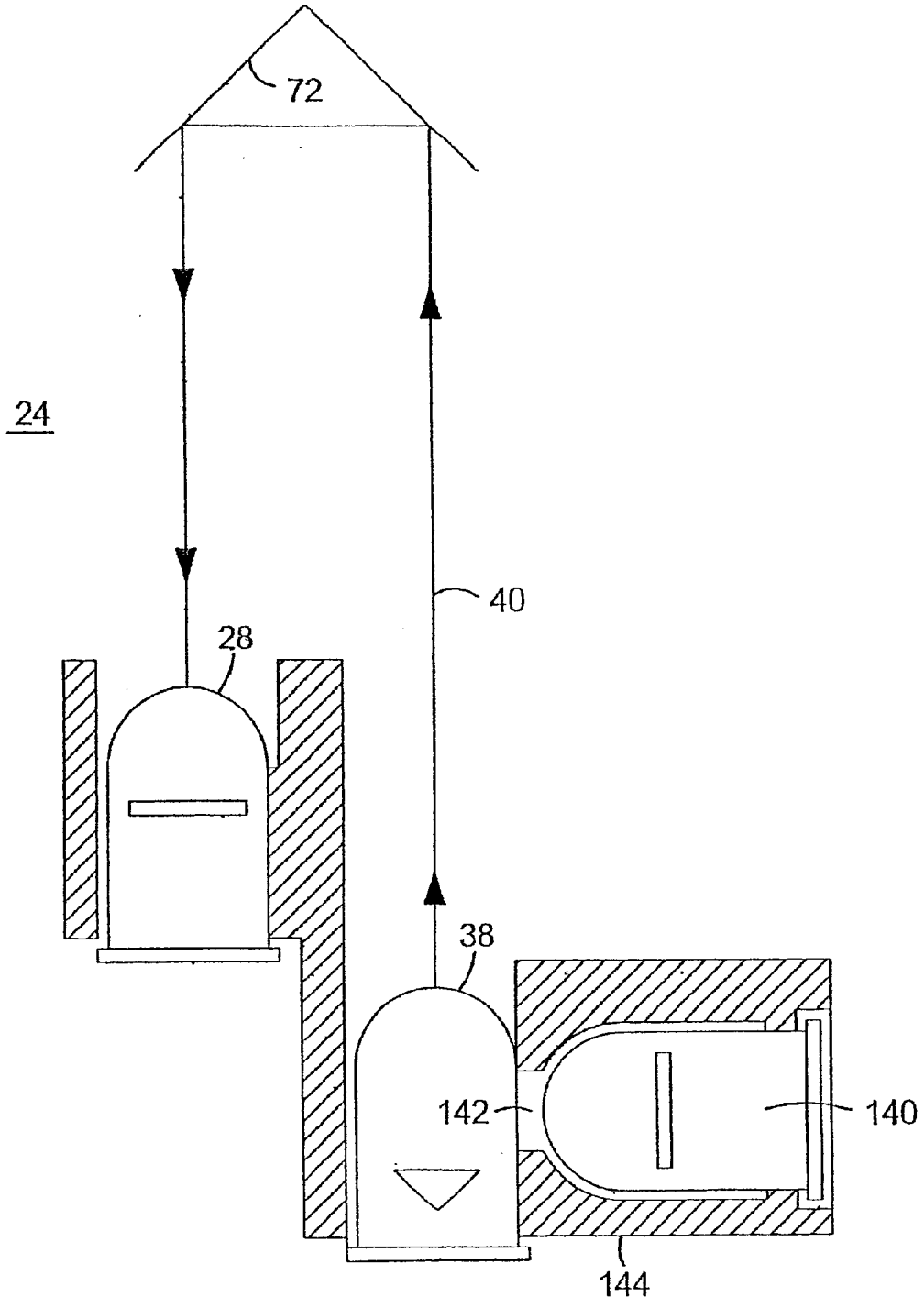
FIG. 10 is a schematic diagram of a dual emitter smoke detector including an optional reference receiver.
Figure 14:
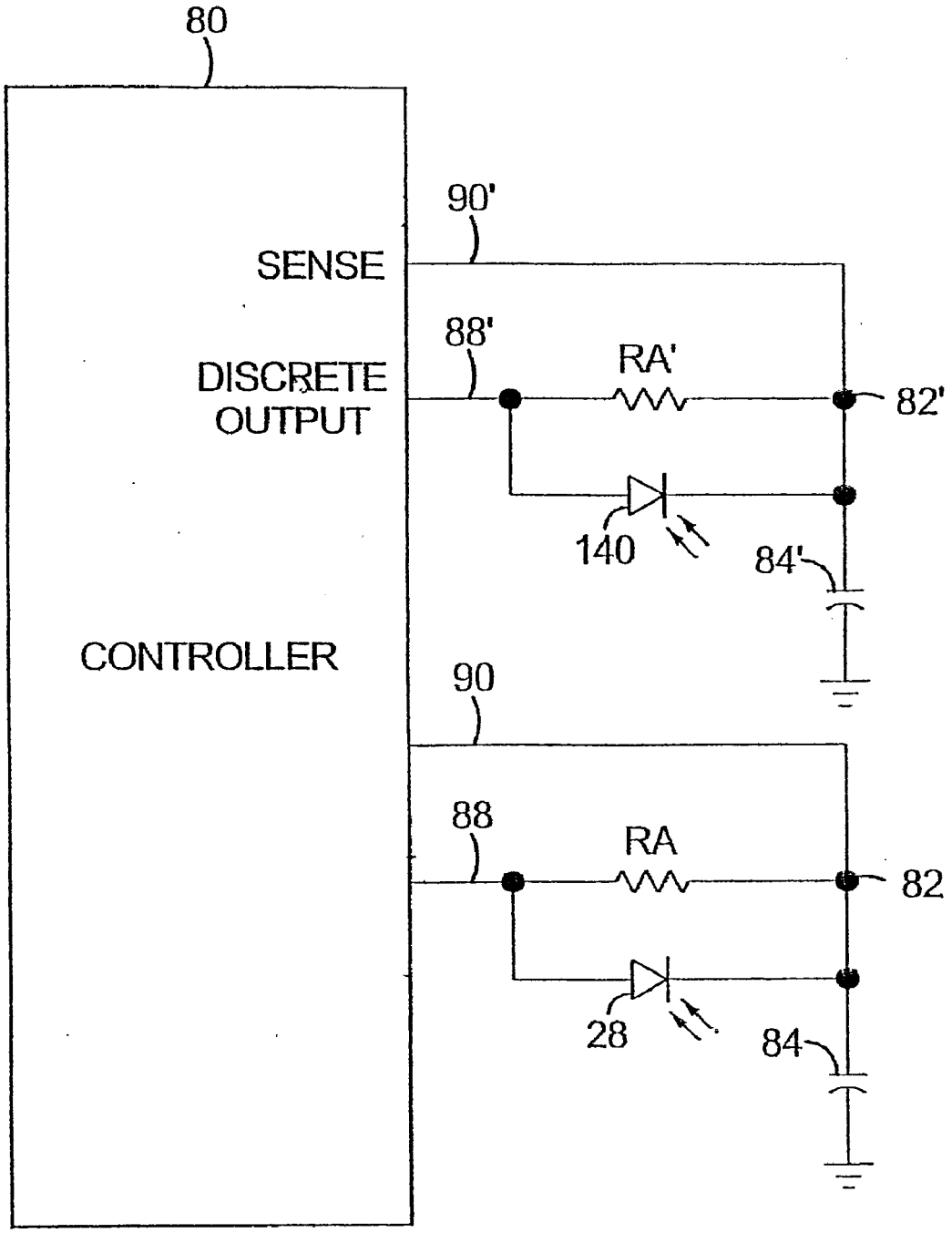
FIG. 14 is a circuit schematic illustrating the electrical connection for an optional reference receiver according to FIG. 10.

Referring now to FIG. 10, a schematic diagram of an embodiment of a dual receiver smoke detector is shown. Second receiver 140 is positioned such that light 142 from obscuration emitter 38 travels along an isolated path different from light 40, the isolated path free from smoke in test atmosphere 24. This may be accomplished by producing a sealed cavity in housing 144 between obscuration emitter 38 and receiver 140, by inserting a light pipe between obscuration emitter 38 and receiver 140, or the like. The receiver 140 is connected in parallel with resistor RA' (FIG. 14) between output 88' of controller 80 and terminal 82'. A capacitor 84' is connected between ground and terminal 82'. A sense input 90' is connected to terminal 82'. The capacitor 84', resistor RA' and receiver 140 may be identical to capacitor 84, resistor RA and receiver 28, respectively. The Controller 80 determines the intensity of light 142 emitted by obscuration emitter 38 by monitoring sense input 90'. Controller 80 then uses the determined intensity of light 142 emitted by obscuration emitter 38 and the intensity of light 40 passing through test atmosphere 28 to more accurately determine the presence of smoke as detected by the obscuration detector. Responsive to obscuration emitter 38, the difference between the time measurements made from receiver 140 and the time measurements made from receiver 28 is indicative of the amount of smoke particles in the dark chamber. Such an arrangement compensates for variations in the performance of emitter 38 and receiver 140.

It is envisioned that improved performance can also be obtained by normalizing for dark current, as an alternative to the ratio-of-ratios technique described above, for those measurements made responsive to the scatter emitter 32, using the dark current voltage 121 range measurement made during the time interval 122 to 123 (FIG. 7). Each of the voltages ranges of the comparator is associated with a respective calibration factor stored in the memory of controller 80. These calibration factors are stored at the factory and are preselected based on measurements taken using a smoke detector under test conditions. The calibration factor for one of the voltage ranges, the normal voltage range, has a value of 1. The calibration factors for each of the other voltage ranges are selected to compensate for the amount that the dark current is expected to vary the actual measurement of elapsed scatter time 118 relative to measurement of elapsed scatter time 118 in the normal voltage range. By multiplying the stored calibration factor by the measured ratio of $T_{118}/T_{110}$, the measured result can be normalized to compensate for the affects of dark current. This is particularly important since the dark current in receiver 28 is highly sensitive to temperature, which significantly impacts on the discharge time of the capacitor 84.

Alternatively, it is envisioned that the stored factor can be multiplied by threshold 108, to vary the threshold 108 such that the larger the dark current voltage 121 measured during period 122 to 123, the higher the threshold 108 during the measurement of the elapsed scatter time 118. It will be recognized that the dark current voltage 121 measurement taken during period 122 to 123 can be taken prior to time period 116, if the threshold 108 is to be adjusted during measurement of the elapsed scatter time 118.

It will be recognized by those skilled in the art that the PIC16CE624 microprocessor from Microchip Technology includes an internal comparator and a resistor network providing 32 reference levels for the internal comparator. The voltage at terminal 82 is compared to each of these reference levels to determine between which of the 32 reference voltages the dark current voltage 121 of the capacitor 84 settles as noted above. The PIC16CE624 microcontroller advantageously includes 32 reference levels that divide the overall voltage range between $V_{DD}$ and ground into non-uniform, contiguous ranges, the smaller ranges providing finer resolution where the dark current voltage 121 on capacitor 84 is likely to settle. However, the reference voltages could alternately be at uniform, contiguous intervals, if desired.

Thus it can be seen that an improved smoke detector is disclosed. The improved smoke detector provides a reliable smoke detect signal without excessive false alarm signals. While embodiments have been illustrated and described, it is not intended that these embodiments illustrate and describe all possible forms of the invention. For example, it is envisioned that the obscuration detector could cause the controller to issue a smoke detect signal when the percent change crosses threshold TH2, rather than changing the scatter detector threshold from TH1 to TH4 when the obscuration detector crosses threshold TH2. Accordingly, the words used in the specification are words of description rather than limitation, and it is understood that various changes may be made without departing from the spirit and scope of the invention.

What is claimed is:

1. A particle detector, comprising:

a housing admitting a test atmosphere;

a first emitter positioned for supplying a light beam into the test atmosphere, where a received portion of the light beam emitted by the first emitter is proportional to the amount of high reflectivity particles present in the test atmosphere;

a second emitter positioned for supplying a light beam into the test atmosphere, where a received portion of the light beam emitted by the second emitter is inversely proportional to the amount of low reflectivity particles present in the test atmosphere;

at least one receiver positioned to receive light supplied by the first and second emitters; and a controller coupled to the first emitter, the second emitter and the at least one receiver, the controller using the amount of particles sensed using one of the first and second emitters to alter an alarm threshold of the remaining emitter.

2. The particle detector of claim 1, wherein the controller is also configured to change a particle detector sensor cycle when a high reflectivity particle level crosses an initial first emitter threshold, and wherein the rate of the particle detector sensor cycle determines the frequency with which at least one of the first and second emitters emits light.

3. The particle detector of claim 2, wherein the controller causes the second emitter to generate light only after the high reflectivity particle level crosses the initial first emitter threshold.

4. The particle detector of claim 3, wherein a first emitter alarm threshold is modified to occur at a lower high reflectivity particle level when a second emitter threshold is exceeded.

5. The particle detector of claim 2, wherein the controller determines the high reflectivity particle level by calculating an initial first emitter ratio whose numerator is related to a first emitter conduction current provided by the receiver in response to light from the first emitter and whose denominator is related to a first emitter dark current provided by the receiver in response to no light from the first emitter.

6. The particle detector of claim 5, wherein the controller compensates for changing environmental conditions and degraded performance of the particle detector by altering a first emitter reference ratio that is used to provide a normalized first emitter ratio that replaces the initial first emitter ratio, wherein the normalized first emitter ratio is used to determine the high reflectivity particle level, and wherein the first emitter reference ratio corresponds to a no particle first emitter ratio that is occasionally updated under a no particle condition.

7. The particle detector of claim 6, wherein the controller determines the low reflectivity particle level by calculating a percentage change in obscuration from one particle detector sensor cycle to another particle detector sensor cycle, and wherein a detected obscuration is related to a difference between a conduction time in which a second emitter conduction current is provided by the receiver in response to light from the second emitter and a second emitter dark time in which a dark current is provided by the receiver in response to no light from the second emitter.

8. The particle detector of claim 7, wherein the controller compensates for changing environmental conditions and degraded performance of the particle detector by setting an obscuration reference, and wherein the obscuration reference is utilized as a base for later determinations of percentage change in obscuration.

9. The particle detector of claim 8, wherein the obscuration reference is set when the first emitter measurement crosses the initial first emitter threshold.

10. A particle detector, comprising:

a housing admitting a test atmosphere;

a first emitter positioned for supplying a light beam into the test atmosphere;

a first receiver positioned to receive light supplied by the first emitter after the light has traveled through the test atmosphere, where a received portion of the light beam emitted by the first emitter and received by the first receiver is inversely proportional to the amount of low reflectivity particles present in the test atmosphere;

a second receiver positioned to receive light from the first emitter, wherein the light received by the second receiver travels along a path isolated from the test atmosphere; and a controller coupled to the first emitter, the first receiver and the second receiver, the controller using the light sensed using the second receiver as a reference for the light sensed using the first receiver to determine the amount of particles present in the test atmosphere.

11. The particle detector of claim 10, further including:

a second emitter positioned for supplying a light beam into the test atmosphere, where a received portion of the light emitted by the second emitter and received by the first receiver is proportional to the amount of high reflectivity particles present in the test atmosphere, and where the second emitter is coupled to the controller and the controller uses the amount of particles sensed using one of the first and second emitters to alter an alarm threshold of the remaining emitter.

12. The particle detector of claim 11, wherein the controller is also configured to change a particle detector sensor cycle when a high reflectivity particle level crosses an initial Second emitter threshold, and wherein the rate of the particle detector sensor cycle determines the frequency with which at least one of the first and second emitters emits light.

13. The particle detector of claim 12, wherein the controller causes the first emitter to generate light only after the high reflectivity particle level crosses the initial second emitter threshold.

14. The particle detector of claim 13, wherein a second emitter alarm threshold is modified to occur at a lower high reflectivity particle level when a first emitter threshold is exceeded.

15. The particle detector of claim 12, wherein the controller determines the high reflectivity particle level by calculating an initial second emitter ratio whose numerator is related to a second emitter conduction current provided by the first receiver in response to light from the second emitter and whose denominator is related to a second emitter dark current provided by the first receiver in response to no light from the second emitter.

16. The particle detector of claim 15, wherein the controller compensates for changing environmental conditions and degraded performance of the particle detector by altering a second emitter reference ratio that is used to provide a normalized second emitter ratio that replaces the initial second emitter ratio, wherein the normalized second emitter ratio is used to determine the high reflectivity particle level, and wherein the second emitter reference ratio corresponds to a no particle second emitter ratio that is occasionally updated under a no particle condition.

17. The particle detector of claim 16, wherein the controller determines the low reflectivity particle level by calculating a percentage change in obscuration from one particle detector sensor cycle to another particle detector sensor cycle, and wherein a detected obscuration is related to a difference between a conduction time in which a first emitter conduction current is provided by the first receiver in response to light from the first emitter and a first emitter dark time in which a dark current is provided by the first receiver in response to no light from the first emitter.

18. The particle detector of claim 17, wherein the controller compensates for changing environmental conditions and degraded performance of the particle detector by setting an obscuration reference, and wherein the obscuration reference is utilized as a base for later determinations of percentage change in obscuration.

19. The particle detector of claim 18, wherein the obscuration reference is set when the second emitter measurement crosses the initial second emitter threshold.

20. A particle detector, comprising:

a housing admitting a test atmosphere;

a first emitter positioned for supplying a light beam into the test atmosphere, where a received portion of the light beam emitted by the first emitter is inversely proportional to the amount of low reflectivity particles present in the test atmosphere;

a second emitter positioned for supplying a light beam into the test atmosphere, where a received portion of the light emitted by the second emitter is proportional to the amount of high reflectivity particles present in the test atmosphere;

a receiver positioned to receive light supplied by the first and second emitters;

a mounting structure for mechanically coupling the first emitter and the receiver to each an optical element positioned to direct the light beam emitted by the first emitter to the receiver, wherein misorientation of at least one of the optical element and the mounting structure with respect to each other is facilitated while maintaining the alignment of the receiver with the first emitter.

21. The particle detector of claim 20, further including:

a controller coupled to the first and second emitters and the receiver, the controller using the amount of particles sensed using one of the first and second emitters to alter an alarm threshold of the remaining emitter.

22. The particle detector of claim 21, wherein the controller is also configured to change a particle detector sensor cycle when a high reflectivity particle level crosses an initial second emitter threshold, and wherein the rate of the particle detector sensor cycle determines the frequency with which at least one of the first and second emitters emits light.

23. The particle detector of claim 22, wherein the controller causes the first emitter to generate light only after the high reflectivity particle level crosses the initial second emitter threshold.

24. The particle detector of claim 23, wherein a second emitter alarm threshold is modified to occur at a lower high reflectivity particle level when a first emitter threshold is exceeded.

25. The particle detector of claim 22, wherein the controller determines the high reflectivity particle level by calculating an initial second emitter ratio whose numerator is related to a second emitter conduction current provided by the receiver in response to light from the second emitter and whose denominator is related to a second emitter dark current provided by the receiver in response to no light from the second emitter.

26. The particle detector of claim 25, wherein the controller compensates for changing environmental conditions and degraded performance of the particle detector by altering a second emitter reference ratio that is used to provide a normalized second emitter ratio that replaces the initial second emitter ratio, wherein the normalized second emitter ratio is used to determine the high reflectivity particle level, and wherein the second emitter reference ratio corresponds to a no particle second emitter ratio that is occasionally updated under a no particle condition.

27. The particle detector of claim 26, wherein the controller determines the low reflectivity particle level by calculating a percentage change in obscuration from one particle detector sensor cycle to another particle detector sensor cycle, and wherein a detected obscuration is related to a difference between a conduction time in which a first emitter conduction current is provided by the receiver in response to light from the first emitter and a first emitter dark time in which a dark current is provided by the receiver in response to no light from the first emitter.

28. The particle detector of claim 27, wherein the controller compensates for changing environmental conditions and degraded performance of the particle detector by setting an obscuration reference, and wherein the obscuration reference is utilized as a base for later determinations of percentage change in obscuration.

29. The particle detector of claim 28, wherein the obscuration reference is set when the second emitter measurement crosses the initial second emitter threshold.

30. The particle detector of claim 20, wherein the optical element is configured to provide a substantially fixed distance between an incoming light beam emitted by the first emitter and impinging on the optical element and an outgoing light beam that is associated with the incoming light beam and is provided by the optical element to the receiver, and wherein the substantially fixed distance is maintained independent of the position of the mounting structure with respect to the optical element and corresponds to the spacing between the first emitter and the receiver.

31. A particle detector, comprising:

a housing admitting a test atmosphere;

a first emitter positioned for supplying a light beam into the test atmosphere;

a first receiver positioned to receive light supplied by the first emitter after the light has traveled through the test atmosphere, where a received portion of the light beam emitted by the first emitter and received by the first receiver is proportional to the amount of high reflectivity particles present in the test atmosphere;

a second receiver positioned to receive light from the first emitter, wherein the light received by the second receiver travels along a path isolated from the test atmosphere; and a controller coupled to the first emitter, the first receiver and the second receiver, the controller using the light sensed using the second receiver as a reference for the light sensed using the first receiver to determine the amount of particles present in the test atmosphere.

32. The particle detector of claim 31, further including:

a second emitter positioned for supplying a light beam into the test atmosphere, where a received portion of the light emitted by the second emitter and received by the first receiver is inversely proportional to the amount of low reflectivity particles present in the test atmosphere, and where the second emitter is coupled to the controller and the controller uses the amount of particles sensed using one of the first and second emitters to alter an alarm threshold of the remaining emitter.

33. A particle detector, comprising:

a housing admitting a test atmosphere;

an emitter positioned for supplying a light beam into the test atmosphere;

a receiver positioned to receive light supplied by the emitter;

a mounting structure for mechanically coupling the emitter and the receiver to each other such that a spacing between the emitter and the receiver is substantially constant; and an optical element positioned to direct a substantial portion of the light beam emitted by the emitter to the receiver, wherein a distance between an incoming portion of the light beam impinging on the optical element and an outgoing portion of the light beam leaving the optical element is substantially the same as the spacing between the emitter and the receiver, and wherein the distance is maintained independent of the position of the mounting structure with respect to the optical element.

34. The particle detector of claim 33, wherein the optical element is a right angle mirror.

* * * * *

UNITED STATES PATENT AND TRADEMARK OFFICE

CERTIFICATE OF CORRECTION

PATENT NO. : 6,653,942 B2
DATED : November 25, 2003
INVENTOR(S) : Brian J. Kadwell and Greg R. Pattok It is certified that error appears in the above-identified patent and that said Letters Patent is hereby corrected as shown below:

Column 6,
Line 22, "16%" should be -- Ω --;

Column 8,
Line 60, "tine" should be -- time --;

Column 9,
Line 48, delete "1";

Column 16,
Line 53, "Second" should be -- second --; and

Column 17,
Line 50, after "each" insert -- other such that a spacing between the first emitter and the receiver is substantially constant; and --.

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,653,942 B2
DATED : November 25, 2003
INVENTOR(S) : Brian J. Kadwell and Greg R. Pattok It is certified that error appears in the above-identified patent and that said Letters Patent is hereby corrected as shown below:

Column 6,
Line 22, "16%" should be -- 16 Ω --;

Column 8,
Line 60, "tine" should be -- time --;

Column 9,
Line 48, delete "1";

Column 16,
Line 53, "Second" should be -- second --; and

Column 17,
Line 50, after "each" insert -- other such that a spacing between the first emitter and the receiver is substantially constant; and --.

This certificate supersedes Certificate of Correction issued June 22, 2004.

Signed and Sealed this

Twenty-fourth Day of August, 2004

JON W. DUDAS
*Director of the United States Patent and Trademark Office*